US010556396B2

(12) United States Patent
Couture et al.

(10) Patent No.: US 10,556,396 B2
(45) Date of Patent: Feb. 11, 2020

(54) METHODS AND A MACHINE FOR FORMING A SHELF-READY SHIPPER DISPLAY SYSTEM

(71) Applicant: WestRock Shared Services, LLC, Norcross, GA (US)

(72) Inventors: David G. Couture, Suwanee, GA (US); Craig W. Buscema, Douglasville, GA (US); Thomas D. Graham, Winter Garden, FL (US); Robert Bradley Teany, Clermont, FL (US); Amer Aganovic, Orlando, FL (US)

(73) Assignee: WestRock Shared Services, LLC, Atlanta, GA (US)

( * ) Notice: Subject to any disclaimer, the term of this patent is extended or adjusted under 35 U.S.C. 154(b) by 635 days.

(21) Appl. No.: 14/968,404

(22) Filed: Dec. 14, 2015

(65) Prior Publication Data

US 2016/0176142 A1 Jun. 23, 2016

Related U.S. Application Data

(60) Provisional application No. 62/094,241, filed on Dec. 19, 2014.

(51) Int. Cl.
*B31B 50/28* (2017.01)
*B31B 50/62* (2017.01)

(52) U.S. Cl.
CPC ..... *B31B 50/28* (2017.08); *B31B 50/62* (2017.08)

(58) Field of Classification Search
CPC ..... B31B 50/28; B31B 3/28; B31B 50/64; B31B 2110/35; B31B 2203/066; B31B 50/00; B31B 50/44; B31B 50/26; B31B 50/62; B31B 50/682; B31B 2100/00; B31B 2120/00; B65D 5/54
USPC ..... 493/51–52, 68, 70, 76, 79–80, 141–143
See application file for complete search history.

(56) References Cited

U.S. PATENT DOCUMENTS 4,066,008 A 1/1978 Arvanigian
4,242,949 A 1/1981 Auckenthaler
4,932,930 A * 6/1990 Coalier ..... B31B 50/00 493/128
5,035,683 A 7/1991 Takeda et al.
5,147,271 A * 9/1992 Bacques ..... B65D 5/001 493/143
5,160,307 A 11/1992 Bacques et al.
5,256,129 A 10/1993 Boix
(Continued)

*Primary Examiner* — Alexander M Valvis
*Assistant Examiner* — Katie L Gerth
(74) *Attorney, Agent, or Firm* — WestRock IP Legal

(57) ABSTRACT

A machine for forming a container from a blank includes a mandrel mounted to a frame. The mandrel includes a first side, an opposite second side, and an external shape complementary to an internal shape of at least a portion of the container. The machine also includes a first presser arm, a folding arm, and a second presser arm each coupled to the frame. The first presser arm is positionable generally proximate the first side of the mandrel and is configured to wrap a first portion of the blank about the mandrel. The folding arm is positionable at least generally proximate the second side of the mandrel and is configured to wrap a second portion of the blank about the mandrel. The second presser arm is disposed generally proximate the first presser arm and is configured to wrap a third portion of the blank about the mandrel.

17 Claims, 13 Drawing Sheets

(56) References Cited

U.S. PATENT DOCUMENTS

| | | | | |
|---|---|---|---|---|
| 5,400,955 | A | 3/1995 | Coalier et al. | |
| 5,624,368 | A | 4/1997 | Cromwell | |
| 5,656,006 | A | 8/1997 | East et al. | |
| 6,106,450 | A | 8/2000 | Brittain | |
| 6,319,183 | B1 | 11/2001 | Ballos | |
| 7,322,171 | B2 | 1/2008 | Bonnain et al. | |
| 7,445,589 | B2 | 11/2008 | Jaen | |
| 7,857,743 | B2 | 12/2010 | Barner | |
| 8,105,223 | B2 | 1/2012 | Graham et al. | |
| 8,342,335 | B2 * | 1/2013 | Couture | B65D 5/5445 206/746 |
| 8,376,141 | B2 * | 2/2013 | Couture | B65D 5/5445 206/746 |
| 8,485,420 | B2 | 7/2013 | Barner | |
| 2003/0119640 | A1 | 6/2003 | Jaen | |
| 2005/0159283 | A1 | 7/2005 | Jaen | |
| 2007/0037682 | A1 | 2/2007 | Scholtes et al. | |
| 2007/0142193 | A1 * | 6/2007 | Strong | B65D 5/722 493/175 |
| 2007/0191201 | A1 | 8/2007 | Reuteler et al. | |
| 2008/0039308 | A1 | 2/2008 | Herrin | |
| 2008/0078819 | A1 | 4/2008 | Strong et al. | |
| 2008/0120947 | A1 | 5/2008 | Oldsen et al. | |
| 2008/0250759 | A1 | 10/2008 | Cash | |
| 2009/0098991 | A1 | 4/2009 | Graham et al. | |
| 2009/0233777 | A1 * | 9/2009 | Greenfield | B65D 5/0281 493/52 |
| 2010/0219232 | A1 | 9/2010 | Smith | |
| 2010/0276333 | A1 | 11/2010 | Couture | |
| 2011/0065559 | A1 | 3/2011 | Atoui | |
| 2011/0281705 | A1 | 11/2011 | Aganovic et al. | |
| 2011/0284621 | A1 | 11/2011 | Couture | |
| 2012/0100976 | A1 | 4/2012 | Graham et al. | |
| 2013/0092596 | A1 | 4/2013 | Couture et al. | |
| 2014/0305837 | A1 | 10/2014 | Couture | |

* cited by examiner

METHODS AND A MACHINE FOR FORMING A SHELF-READY SHIPPER DISPLAY SYSTEM

CROSS-REFERENCE TO RELATED APPLICATIONS

This application claims priority to U.S. Provisional Patent Application No. 62/094,241, filed Dec. 19, 2014, entitled "METHODS AND A MACHINE FOR FORMING A SHELF-READY SHIPPER DISPLAY SYSTEM," the entire contents of which are hereby incorporated by reference in their entirety.

BACKGROUND

This invention relates generally to a machine for forming containers from a blank of sheet material, and more specifically to methods and a machine for forming a shelf-ready shipper display system from a blank of sheet material by wrapping the blank around a mandrel.

Containers fabricated from paperboard and/or corrugated paperboard material are often used to store and transport goods. Such containers are usually formed from blanks of sheet material that are folded along a plurality of preformed fold lines to form an erected corrugated container. At least some known blanks include a pair of end panels, a pair of side panels, a glue panel, a bottom panel, and, in some cases, a top panel, connected by a plurality of fold lines. The panels are rotated to form end walls, side walls, a bottom wall, and a top wall of the container. In addition, at least some known blanks include a reinforcement panel in series with the side and end panels. The reinforcement panel adds strength and/or other desirable properties to the container walls, and may provide a tab to facilitate removal of a top portion of the container from a display portion of the container at the retail location.

Moreover, at least some known containers are formed from a blank using a high-speed machine in an automated process. At least some known high-speed container-forming machines at least partially form the container by wrapping the blank about a mandrel. Such high-speed container-forming machines facilitate forming a container with increased strength and tighter manufacturing tolerances, and with attendant decreased waste of blank material. Such known high-speed container-forming machines, however, are not used to form a container from a blank with a reinforcement panel in series with the side and end panels, because of the challenge of accommodating the reinforcement panel.

BRIEF DESCRIPTION OF THE DISCLOSURE

In one aspect, a machine for forming a container from a blank is provided. The machine includes a mandrel coupled to a frame. The mandrel includes a first side, an opposite second side, and an external shape complementary to an internal shape of at least a portion of the container. The machine also includes a first presser arm associated with the frame. The first presser arm is positionable generally proximate the first side of the mandrel and is configured to wrap a first portion of the blank about the mandrel. The machine further includes a folding arm associated with the frame. The folding arm is positionable at least generally proximate the second side of the mandrel and is configured to wrap a second portion of the blank about the mandrel. Additionally, the machine includes a second presser arm associated with the frame. The second presser arm is disposed generally proximate the first presser arm and is configured to wrap a third portion of the blank about the mandrel.

In another aspect, a method for forming a container from a blank using a machine is provided. The machine includes a mandrel, a first presser arm positionable generally proximate a first side of the mandrel, a folding arm positionable at least generally proximate a second side of the mandrel opposite the first side, and a second presser arm disposed generally proximate the first presser arm. The method includes positioning the blank under the mandrel, wrapping a first portion of the blank about the mandrel using the first presser arm, wrapping a second portion of the blank about the mandrel using the folding arm, and wrapping a third portion of the blank about the mandrel using the second presser arm. The method also includes ejecting the container from the mandrel after the first portion, the second portion, and the third portion of the blank are wrapped about the mandrel.

In another aspect, a container formed from a blank using a machine is provided. The machine includes a mandrel, a first presser arm positionable generally proximate a first side of the mandrel, a folding arm positionable at least generally proximate a second side of the mandrel opposite the first side, and a second presser arm disposed generally proximate the first presser arm. The blank includes a reinforcement panel, a first side panel, a first end panel, a second side panel, a second end panel, and a glue panel connected in series along a plurality of parallel fold lines. The container is formed by the process of positioning the second side panel under the mandrel, wrapping at least the second end panel about the mandrel using the first presser arm, wrapping at least the first end panel and the first side panel about the mandrel using the folding arm, wrapping at least the reinforcement panel of the blank about the mandrel using the second presser arm, and ejecting the container from the mandrel after the second end panel, the first end panel, and the reinforcement panel are wrapped about the mandrel.

DETAILED DESCRIPTION OF THE DISCLOSURE

The methods and machine for forming corrugated containers described herein overcome the limitations of known container-forming machines. As described herein, the containers include an outer or reinforcing panel configured to reinforce the erected container in filling and shipping configurations. The reinforcement panel may further protect a front panel therebeneath from damage during filling and/or shipping. The container described herein features the outer reinforcement panel with a tap portion configured to facilitate removal of at least a portion of the reinforcement panel, along with at least a top wall of the container, to transition the container into a display configuration. The methods and machine described herein include a glue panel folder plate located apart from a glue panel presser and selectably positionable between a first position configured to avoid interference with a reinforcement panel during an initial wrapping process and a second position configured to fold a glue panel into an assembly configuration. The methods and machine described herein also include a second presser arm configured to wrap the reinforcement panel about the mandrel. Accordingly, the methods and machine described herein facilitate high-speed processing of blanks to form the containers for improved efficiency and increased output.

Figure 1:
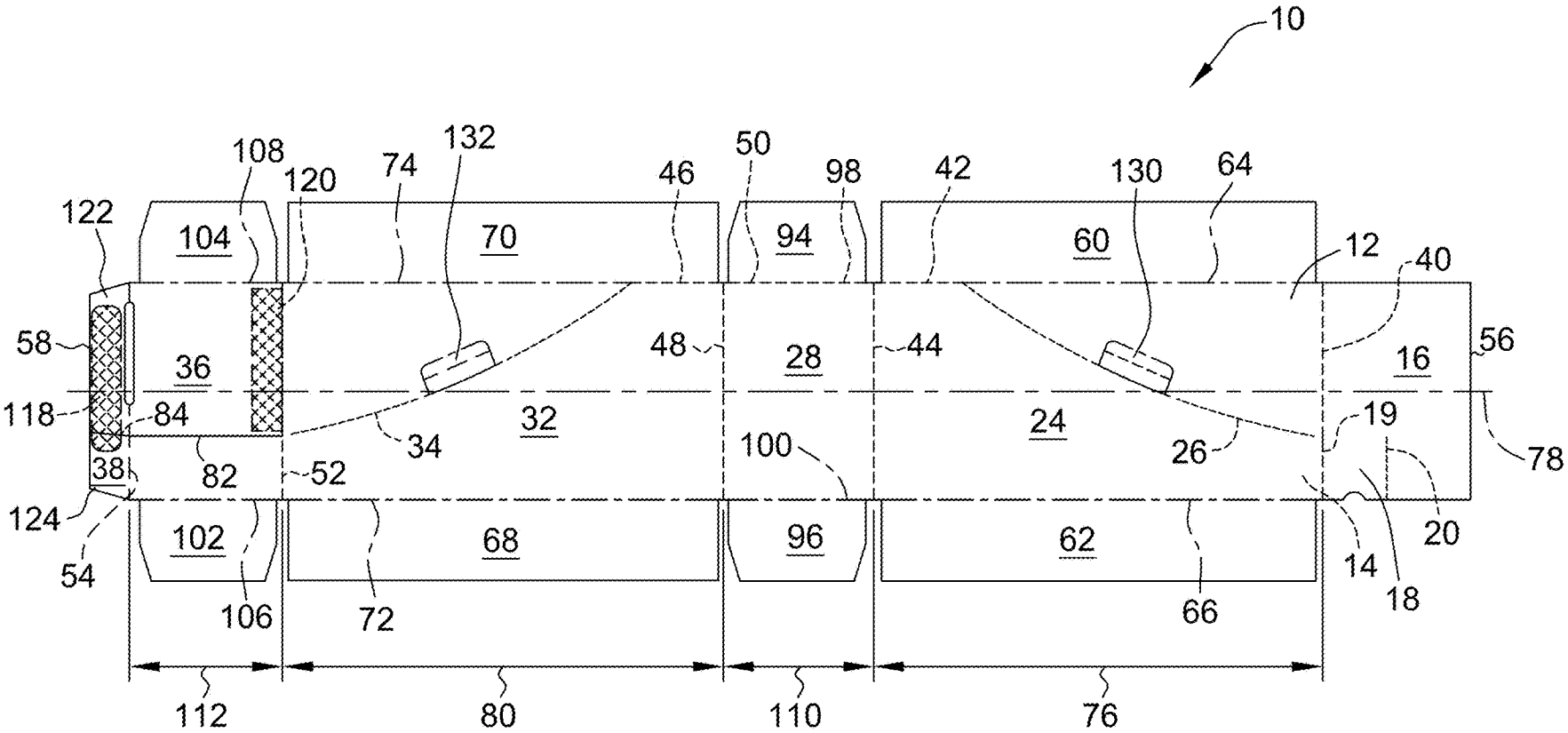
FIG. 1 is a top plan view of an example embodiment of a blank of sheet material that may be used with the machine described herein for forming a shipper display container.

FIG. 1 illustrates a top plan view of an example embodiment of a substantially flat blank 10 of sheet material. As shown in FIG. 1, blank 10 has an interior surface 12 and an exterior surface 14. In certain embodiments, portions of exterior surface 14 and/or interior surface 12 of blank 10 include printed graphics, such as advertising and/or promotional materials.

Blank 10 includes a series of aligned wall panels and end panels connected together by a plurality of preformed, generally parallel, fold lines. Specifically, the wall panels include a reinforcement panel 16, a first side panel 24, a first end panel 28, also referred to as a rear end panel 28, a second side panel 32, a second end panel 36, also referred to as a front end panel 36, and a glue panel 38 connected in series along a plurality of parallel fold lines 40, 44, 48, 52, and 54. Reinforcement panel 16 extends from a first free edge 56 to fold line 40, first side panel 24 extends from reinforcement panel 16 along fold line 40, first end panel 28 extends from first side panel 24 along fold line 44, second side panel 32 extends from first end panel 28 along fold line 48, second end panel 36 extends from second side panel 32 along fold line 52, and glue panel 38 extends from second end panel 36 along fold line 54 to a second free edge 58.

A first top side panel 60 and a first bottom side panel 62 extend from opposing edges of first side panel 24. More specifically, first top side panel 60 and first bottom side panel 62 extend from first side panel 24 along a pair of opposing preformed, generally parallel, fold lines 64 and 66, respectively. Similarly, a second bottom side panel 68 and a second top side panel 70 extend from opposing edges of second side panel 32. More specifically, second bottom side panel 68 and second top side panel 70 extend from second side panel 32 along a pair of opposing preformed, generally parallel, fold lines 72 and 74, respectively. Fold lines 64, 66, 72, and 74 are generally parallel to each other and generally perpendicular to fold lines 40, 44, 48, and 52. First side panel 24 has a width 76 taken along a central horizontal axis 78 of blank 10 that is substantially equal to a width 80 taken along central horizontal axis 78 of second side panel 32.

As shown in FIG. 1, a first top end panel 94 and a first bottom end panel 96 extend from opposing edges of first end panel 28. More specifically, first top end panel 94 and first bottom end panel 96 extend from first end panel 28 along a pair of opposing preformed, generally parallel, fold lines 98 and 100, respectively. Similarly, a second bottom end panel 102 and a second top end panel 104 extend from opposing edges of second end panel 36. More specifically, second bottom end panel 102 and second top end panel 104 extend from second end panel 36 along a pair of opposing preformed, generally parallel, fold lines 106 and 108, respectively. Fold lines 98, 100, 106, and 108 are generally parallel to each other and generally perpendicular to fold lines 44, 48, 52, and 54. First end panel 28 has a width 110 taken along central horizontal axis 78 of blank 10 that is substantially equal to a width 112 of second end panel 36, also taken along central horizontal axis 78.

First side panel 24 includes a line of weakening 26, and second side panel 32 includes a line of weakening 34. As used herein, the term "line of weakening" refers to any preformed line, such as but not limited to score lines, perforation lines, or lines of separation, along which the blank material is configured to have a relatively decreased resistance to folding or tearing. In the example embodiment, line of weakening 26 extends from a first side edge of first side panel 24, defined by fold line 40, to a top edge of first side panel 24 defined by fold line 64. Similarly, in the example embodiment, line of weakening 34 extends from a first side edge of second side panel 32, defined by fold line 52, to a top edge of second side panel 32 defined by fold line 74. In addition, in the example embodiment, a line of weakening 42 extends along fold line 64 from an intersection with line of weakening 26 to a second, opposing side edge of first side panel 24 defined by fold line 44, and a line of weakening 46 extends along fold line 74 from an intersection with line of weakening 34 to a second, opposing side edge of second side panel 32 defined by fold line 48. Moreover, a line of weakening 50 extends along a top edge of rear end panel 28, coextensively with fold line 98, between line of weakening 42 and line of weakening 46.

In certain alternative embodiments, line of weakening 26 extends from a first corner of first side panel 24 defined by an intersection of fold lines 40 and 66, and line of weakening 34 extends from a first corner of second side panel 32 defined by an intersection of fold lines 52 and 72. Additionally or alternatively, in certain alternative embodiments, line of weakening 26 extends to a second corner of first side panel 24 defined by an intersection of fold lines 44 and 64, and line of weakening 34 extends to a second corner of second side panel 32 defined by an intersection of fold lines 48 and 74.

In the example embodiment, a cut line 82 extends across front end panel 36 from a first edge defined by fold line 54, to a second, opposing edge defined by fold line 52. Cut line 82 approximately intersects with line of weakening 34 at fold line 52, and approximately intersects at fold line 54 with a line of weakening 84 defined in glue panel 38. Similarly, line of weakening 84 is configured to be approximately congruent with line of weakening 26 proximate to fold line 40 when blank 10 is formed into a container 200 (shown in FIG. 2). Although cut line 82 is illustrated as a straight horizontal line in the example embodiment, cut line 82 may have a curved and/or multi-segmented shape in alternative embodiments. Moreover, in alternative embodiments, line 82 is formed as a line of weakening rather than a cut line. However, in certain embodiments, the use of a cut line for line 82 presents advantages as will be described herein.

In certain embodiments, blank 10 includes a tab portion 18. In the example embodiment, tab portion 18 is defined on reinforcement panel 16 by a line of weakening 19 disposed along a lower portion of fold line 40 and a line of weakening 20 disposed substantially parallel to line of weakening 19 along a central lower portion of reinforcement panel 16. Also, in certain embodiments, first side panel 24 includes a punch-out area 130 disposed adjacent to line of weakening 26, and second side panel 32 includes a punch-out area 132 adjacent to line of weakening 34.

Figure 2:
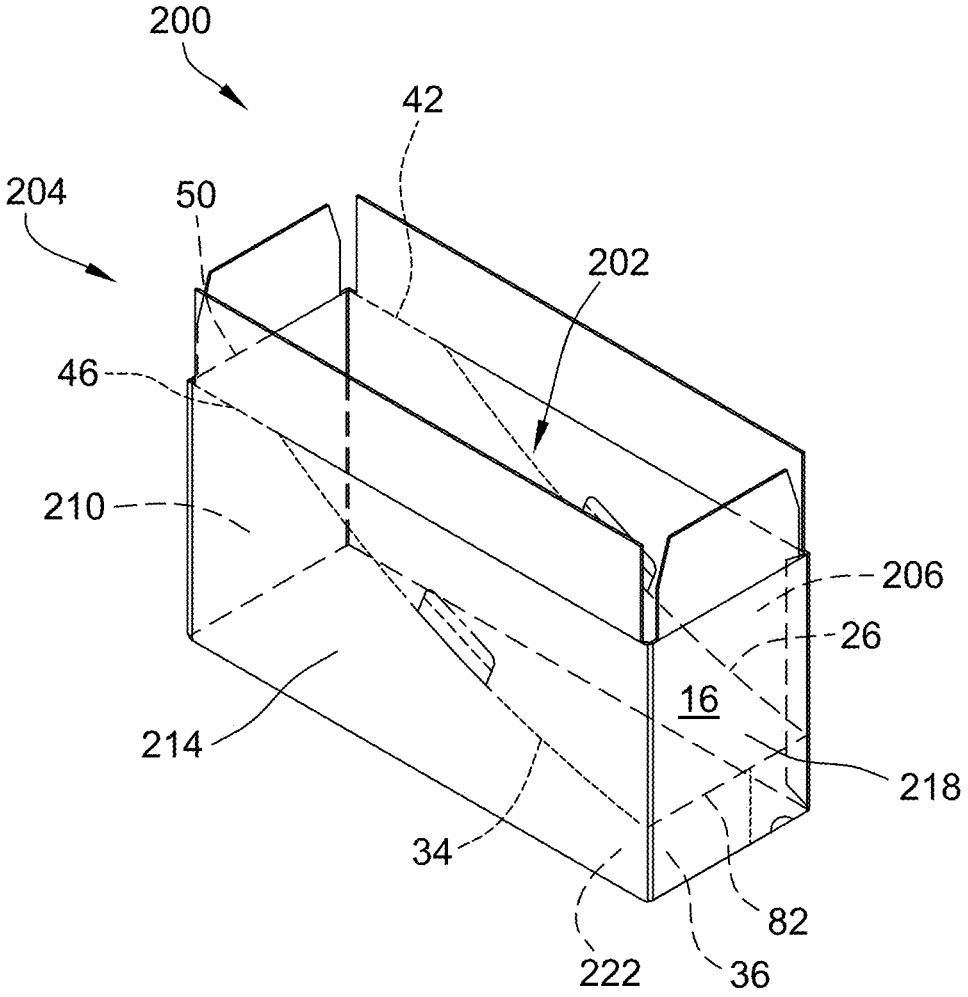
FIG. 2 is perspective view of an example embodiment of a shipper display container that may be formed from the blank shown in FIG. 1.
Figure 3:
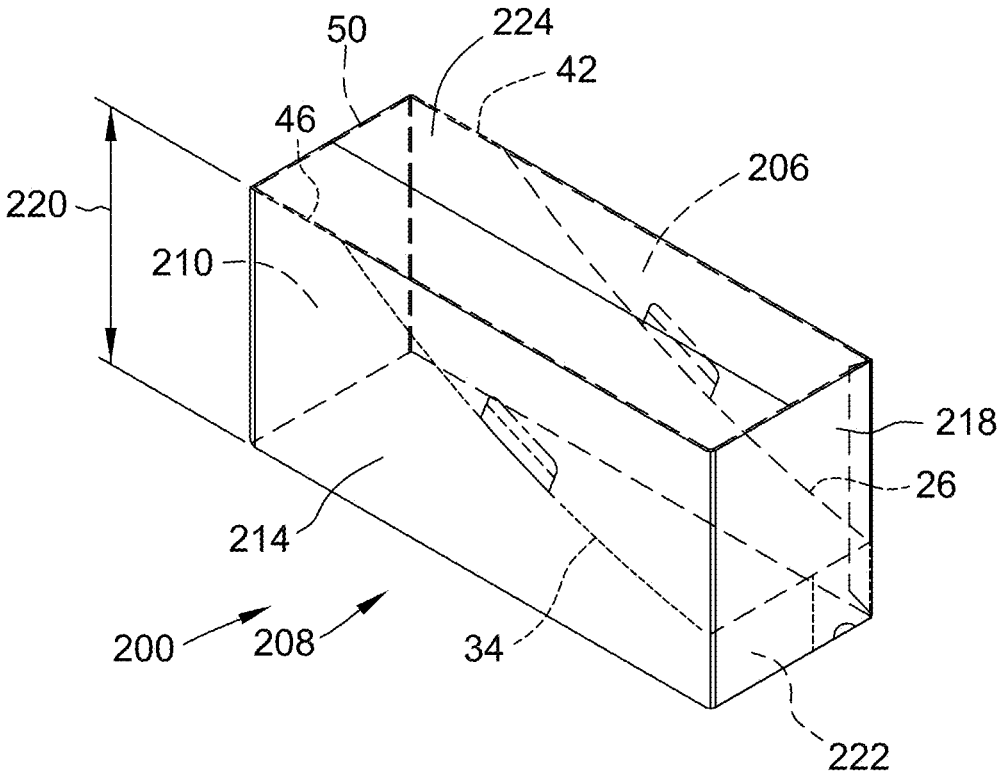
FIG. 3 is a perspective view of the example shipper display container shown in FIG. 2 in a closed or shipping configuration.
Figure 4:
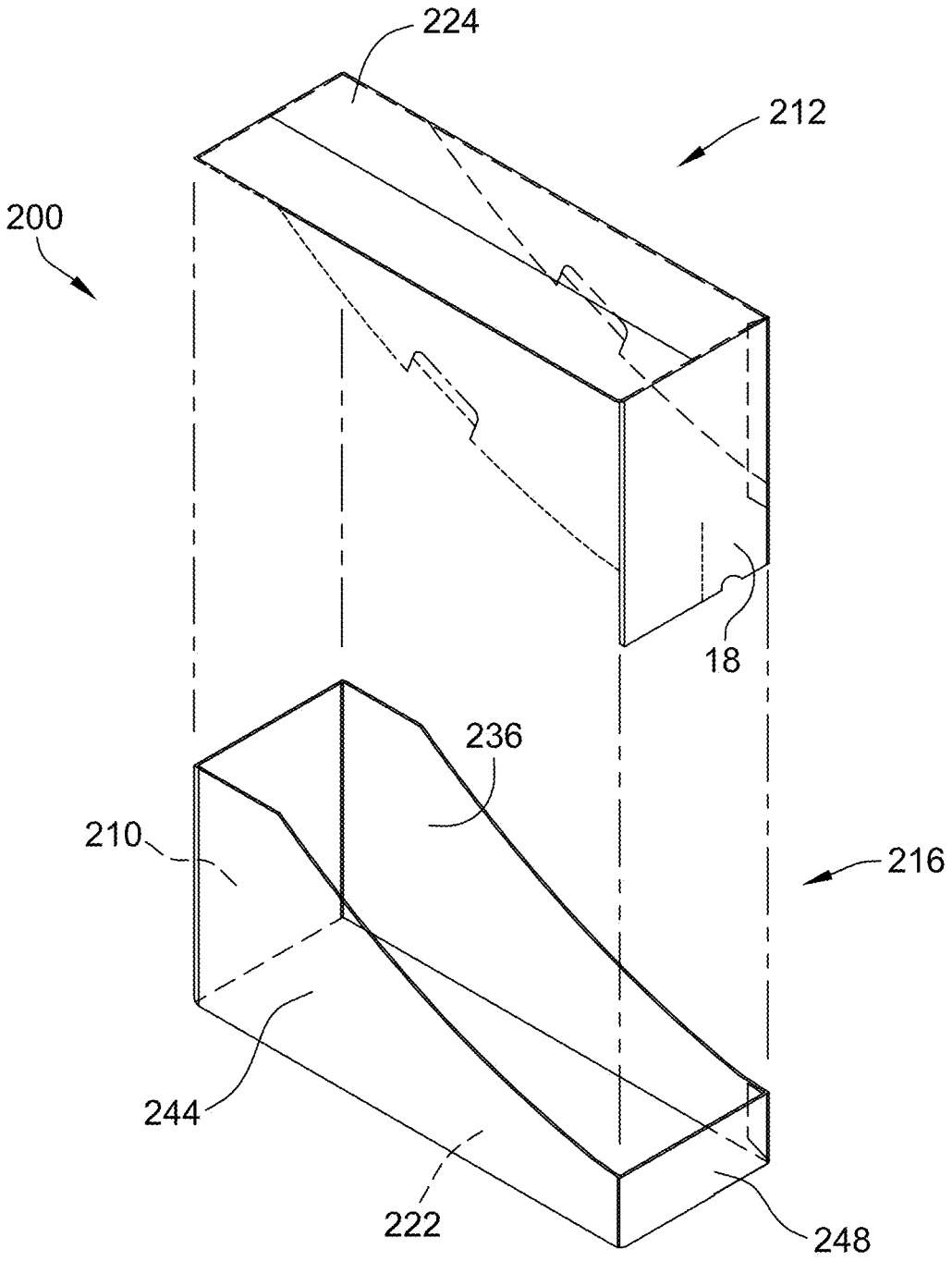
FIG. 4 is perspective view of the example shipper display container shown in FIGS. 2 and 3 in a display configuration with the removable section shown.

As will be described below in more detail with reference to FIGS. 5-13, blank 10 is intended to form container 200 as shown in FIGS. 2-4 by folding and/or securing panels 16, 24, 28, 32, 36, and/or 38 (shown in FIG. 1) and bottom panels 62, 68, 96, and/or 102 (shown in FIG. 1). Of course, blanks having shapes, sizes, and configurations different from blank 10 described and illustrated herein may be used to form container 200 shown in FIGS. 2-4 without departing from the scope of the present disclosure. In other words, the machine and processes described herein can be used to form a variety of different shaped and sized containers, and is not limited to blank 10 shown in FIG. 1 and/or container 200 shown in FIGS. 2-4.

FIG. 2 illustrates a perspective view of example container 200, which is erected into a filling configuration 204 with top open, that may be formed from blank 10 (shown in FIG. 1). FIG. 3 illustrates container 200 in a shipping configuration 208, with the top closed. FIG. 4 illustrates a perspective view of container 200 with a shipping cover portion 212 removed, converting container 200 to a display configuration 216. For example, container 200 may be erected into filling configuration 204 and filled with product at a packing facility, converted into shipping configuration 208 by closing the top, shipped to a retail facility, and converted into display configuration 216 and placed on a shelf at the retail facility, where consumers can view and extract product for purchase directly from container 200.

Referring to FIGS. 1-3, in the example embodiment, container 200 includes a plurality of walls defining a cavity 202. More specifically, container 200 in both filling configuration 204 and shipping configuration 208 includes a first side wall 206, a first end wall 210, a second side wall 214, and a second end wall 218. First side wall 206 includes first side panel 24 and glue panel 38, first end wall 210 includes first end panel 28, and second side wall 214 includes second side panel 32. Moreover, line of weakening 26 is intact on first side wall 206, and line of weakening 34 is intact on second side wall 214. In addition, line of weakening 42 is intact along a portion of a top edge of first side wall 206, line of weakening 46 is intact along a portion of a top edge of second side wall 214, and line of weakening 50 is intact along a top edge of first end wall 210. Further, in the example embodiment, second end wall 218 includes second end panel 36 and reinforcement panel 16. Reinforcement panel 16 advantageously provides structural strength to second end wall 218, and tends to compensate for a loss of strength occasioned by the presence of cut line 82 in second end panel 36 in second end wall 218.

Although each wall 206, 210, 214, and 218 may have a different height without departing from the scope of the present disclosure, in the embodiment shown FIGS. 1-3, each wall 206, 210, 214, and 218 has substantially the same height 220 in both filling configuration 204 and shipping configuration 208. Additionally, although container 200 may have other orientations without departing from the scope of the present disclosure, in the embodiments shown in FIGS. 2 and 3, end walls 210 and 218 are substantially parallel to each other, and side walls 206 and 214 are substantially parallel to each other.

In the example embodiment, bottom panels 62, 68, 96, and 102 are each orientated generally perpendicular to walls 206, 210, 214, and 218 to form a bottom wall 222. More specifically, bottom end panels 96 and 102 are folded beneath/inside of bottom side panels 62 and 68. Similarly, in shipping configuration 208 (shown in FIG. 3), top panels 60, 70, 94, and 104 are each orientated generally perpendicular to walls 206, 210, 214, and 218 to form a top wall 224.

Although container 200 may be secured together using any suitable fastener at any suitable location on container 200 without departing from the scope of the present disclosure, in certain embodiments, adhesive (not shown) is applied to an inner surface and/or an outer surface of first side panel 24 and/or glue panel 38 to form first side wall 206, and adhesive (not shown) is applied to an inner surface and/or an outer surface of front end panel 36 and/or reinforcement panel 16 to form second end wall 218. For example, in the embodiment illustrated in FIG. 1, blank 10 includes two areas on which adhesive is applied before or during the process in which blank 10 is formed into container 200. In the example embodiment, glue area 118 is disposed on exterior surface 14 of a middle portion of glue panel 38, leaving top portion 122 and bottom portion 124 of glue panel 38 free of adhesive. In addition, glue area 120 is disposed on exterior surface 14 of front end panel 36. In the example embodiment, glue area 120 is disposed entirely above cut line 82, for reasons that will be described herein. In alternative embodiments, glue areas 118 and 120 may be placed at any suitable location that allows container 200 to be constructed as described herein.

In certain embodiments, adhesive may also be applied to exterior surfaces 14 of bottom end panels 96 and/or 102 and/or interior surfaces 12 of bottom side panels 62 and/or 68 to secure bottom side panels 62 and/or 68 to bottom end panels 96 and/or 102. Similarly, adhesive may also be applied to exterior surfaces 14 of top end panels 94 and/or 104 and/or interior surfaces 12 of top side panels 60 and/or 70 to secure top side panels 60 and/or 70 to top end panels 94 and/or 104. As a result of the above example embodiment of container 200, each of a manufacturing joint between glue panel 38 and first side panel 24, a joint between front end panel 36 and reinforcement panel 16, bottom wall 222, and top wall 224 may be securely contained within container 200. Therefore, less material may be used to fabricate a stronger container 200.

With reference to FIGS. 3 and 4, in the example embodiment, container 200 is converted from shipping configuration 208 to display configuration 216 by breaking lines of weakening 26 and 34 on side walls 206 and 214 respectively, breaking lines of weakening 42 and 46 along the top edges of side walls 206 and 214 respectively, and breaking line of weakening 50 along the top edge of first end wall 210. This causes top wall 224, portions of side walls 206 and 214 above lines of weakening 26 and 34 respectively, and a portion of front end panel 36 above cut line 82, as well as reinforcement panel 16, which is adhered to front end panel 36 above cut line 82, to be separated from container 200 into removable shipping cover portion 212.

After removal of shipping cover portion 212, container 200 in display configuration 216 includes first end wall 210 and bottom wall 222, as well as first display side wall 236, second display side wall 244, and front display wall 248. First display side wall 236 includes the portion of first side panel 24 below lines of weakening 26 and 42 and the portion of glue panel 38 below line of weakening 84, second display side wall 244 includes the portion of second side panel 32 below lines of weakening 34 and 46, and front display wall 248 includes the portion of front end panel 36 below cut line 82.

In the example embodiment, the use of a cut line for line 82, rather than a perforation or other line of weakening, facilitates the presentation of a smooth top edge of front display wall 248. In addition, reinforcement panel 16 provides a protective cover for any graphics or promotional materials displayed on front display wall 248 while container 200 is in filling configuration 204 and shipping configuration 208. Thus, the configuration of container 200 facilitates the presentation of a clean appearance of front display wall 248 when container 200 is converted to display configuration 216.

Tab 18 can be used to facilitate removal of shipping cover portion 212 from container 200. More specifically, in the example embodiment, tab 18, which is part of reinforcement panel 16, may be gripped and pulled upwards by a user, imparting a separation force to lines of weakening 26, 34, 42, 46, and/or 50. Similarly, a user may insert his or her hand into punch-outs 130 and/or 132 and pull upwards to impart a separation force to facilitate removal of shipping cover portion 212. However, use of tab 18 and/or punch-outs 130 and 132 is not necessary to remove shipping cover portion 212. In alternative embodiments, tab 18 and/or punch-outs 130 and 132 have alternative sizes or configurations, and may be positioned at any suitable location on reinforcement panel 16 and/or shipping cover portion 212. For example, in certain embodiments, tab 18 and/or punch-outs 130 and 132 are implemented as cut-outs. In other embodiments, tab 18 and/or punch-outs 130 and 132 are not present on blank 10 and container 200.

Figure 5:
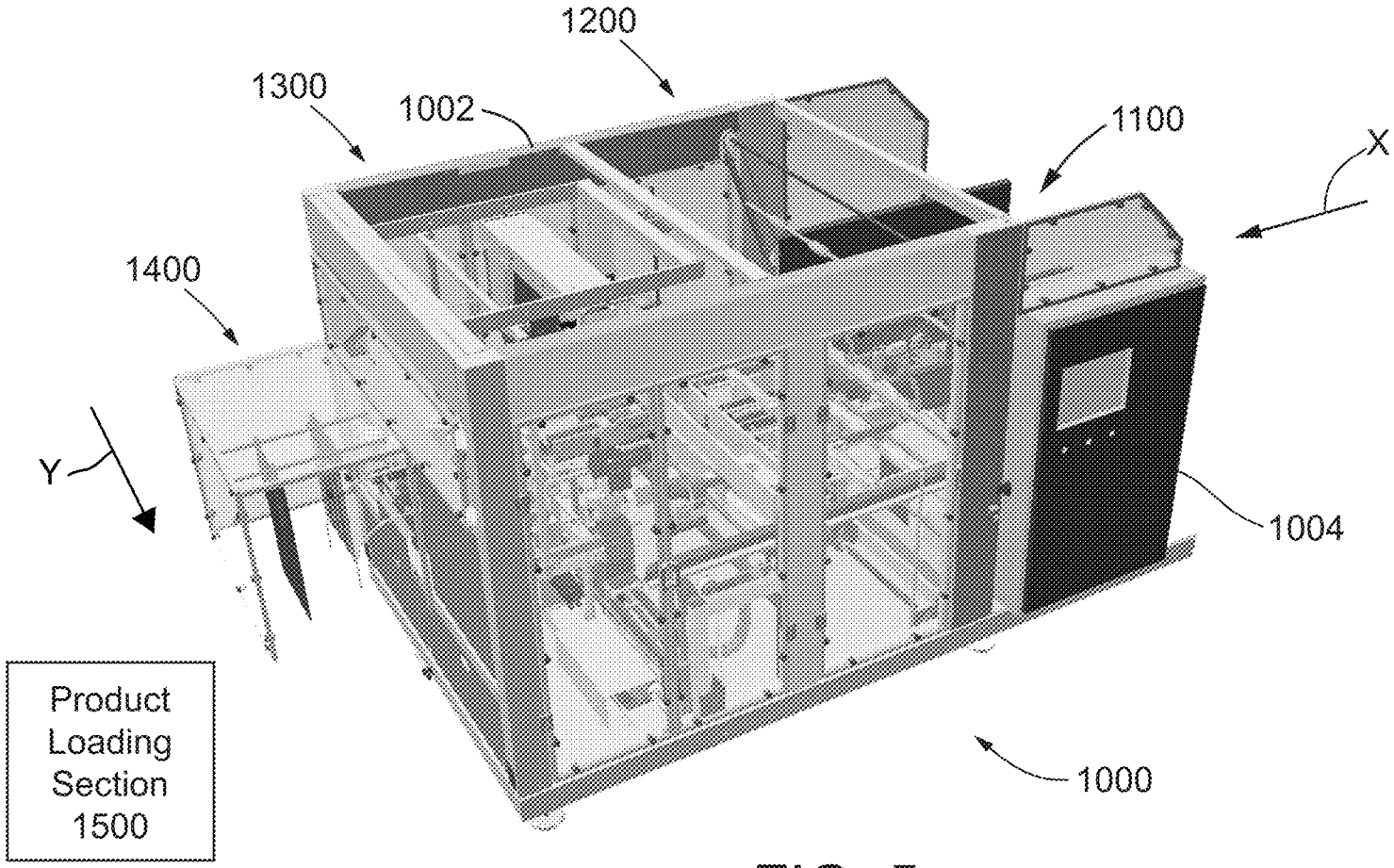
FIG. 5 is a perspective view of an example embodiment of a machine that may be used to form a shipper display container from the blank of sheet material shown in FIG. 1.
Figure 6:
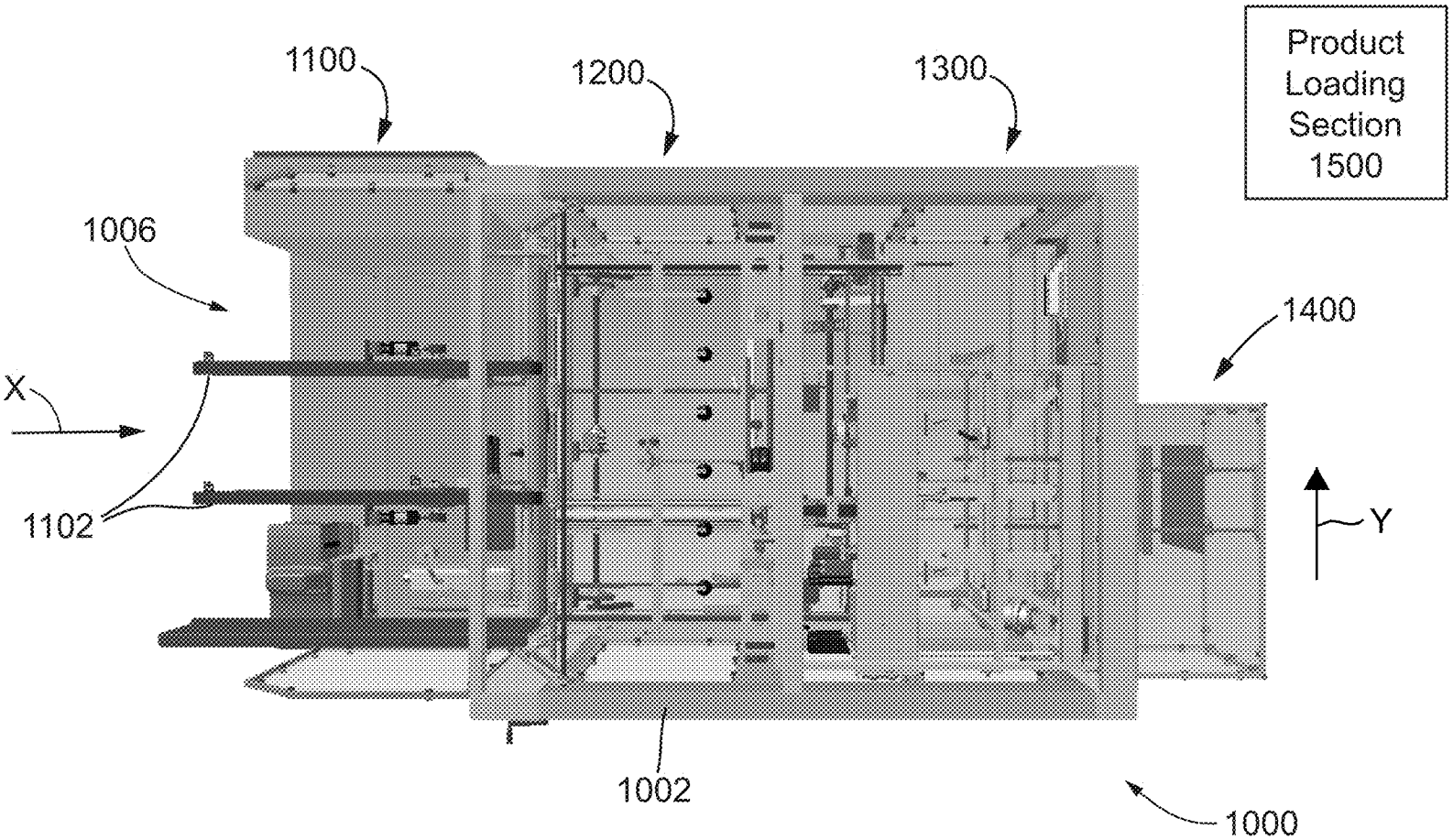
FIG. 6 is another perspective view of the example machine shown in FIG. 5.

FIG. 5 illustrates a perspective view of an example machine 1000 for forming a container, such as container 200 (shown in FIGS. 2-4), from a blank of sheet material, such as blank 10 (shown in FIG. 1). FIG. 6 illustrates another perspective view of machine 1000. Machine 1000 will be discussed thereafter with reference to forming corrugated container 200 from blank 10; however, machine 1000 may be used to form a box or any other container having any size, shape, and/or configuration from a blank having any size, shape, and/or configuration without departing from the scope of the present disclosure. For example, the blanks may, but need not, include lines of weakening such as lines 26, 34, 42, 46, and/or 50 configured to form a shelf-ready shipper display container 200.

As shown in FIGS. 5 and 6, machine 1000 includes a magazine feed section 1100, a transfer section 1200, a mandrel wrapping section 1300, an outfeed section 1400, and a product load section 1500 positioned with respect to and/or coupled to a frame 1002. A control system 1004 is coupled in operative control communication with components of machine 1000. In the example embodiment, actuators are used to raise, lower and/or rotate one or more plates and/or folding arms that wrap the blank around the mandrel, and to move one or more presser bars that facilitate the formation of joints in container 200, as will be described in more detail below. The actuators may include, for example, jacks, mechanical linkages, servomechanisms, other suitable mechanical or electronic actuators, or any suitable combination thereof. As used herein, the terms "servo-actuated" and "servo-controlled" refers to any component and/or device having its movement controlled by a servomechanism. As described herein, a control system is any suitable system that controls the movement and/or timing of at least one actuator or other mechanically or electronically driven component of machine 1000.

In certain embodiments, such as, but not limited to, embodiments where at least one servomechanism is used, control system 1004 may enable an operator to change recipes or protocols by making a selection on a user interface. The recipes are computer instructions for controlling the machine to form different size boxes, different types of boxes, and/or control the output of the formed containers. The different recipes control the speed, timing, force applied, and/or other motion characteristics of the different forming components of the machine including how the components move relative to one another. However, the processes and systems described herein are not limited in any way to the corrugated container shown herein. Rather, the processes and systems described herein can be applied to a plurality of container types manufactured from a plurality of materials.

Magazine feed section 1100 is positioned at an upstream end 1006 of machine 1000 with respect to a sheet loading direction indicated by an arrow X. Transfer section 1200 is positioned downstream from magazine feed section 1100 in sheet loading direction X. Moreover, mandrel wrapping section 1300 is positioned downstream from transfer section 1200 in sheet loading direction X. Further, outfeed section 1400 is positioned downstream from mandrel wrapping section 1300 in sheet loading direction X, and product load section 1500 is positioned downstream from outfeed section 1400 with respect to a container discharge direction indicated by an arrow Y. Product load section 1500 is where a product is loaded into formed container 200, and container 200 is closed and sealed for shipping and/or storing the product. The different sections 1100, 1200, 1300, 1400, and/or 1500 (and/or individual components thereof) may be integral to frame 1002 or may be separate sections that are positioned relative to one another to form machine 1000.

Magazine feed section 1100 is configured to receive a plurality of blanks 10 (shown in FIG. 1). For example, blanks 10 may be received in powered magazine drives 1102. Blanks 10 are orientated in any manner that enables operation of machine 1000 as described herein. Magazine feed section 1100 is further configured to convey blanks 10 in sheet loading direction X to transfer section 1200 in any suitable fashion. In certain embodiments, the operation of magazine feed section 1100 is automatically controlled by control system 1004.

Transfer section 1200 is configured to select a blank 10 from magazine feed section 1100 and feed blank 10 toward mandrel wrapping section 1300. For example, transfer section 1200 may pick up a blank using a plurality of vacuum suction cups coupled to a servo-controlled pick-up bar (not shown), and feed the selected blank 10 towards mandrel wrapping section 1300 using a pusher assembly (not shown). In alternative embodiments, transfer section 1200 may include any suitable structure and/or means for attaching to blank 10 and transferring it from magazine feed section 1100 to mandrel wrapping section 1300 without departing from the scope of the present disclosure. Transfer section 1200 also may include an automated adhesive applicator that applies adhesive to predetermined areas of blank 10. In the example embodiment, adhesive is applied to exterior surface 14 of blank 10 at glue areas 118 and 120 (shown in FIG. 1) while blank 10 is being fed towards mandrel wrapping section 1300. In certain embodiments, the operation of transfer section 1200 is automatically controlled by control system 1004.

FIGS. 7-12 illustrate various configurations of an example mandrel wrapping section 1300. Blanks 10 are received in mandrel wrapping section 1300 from transfer section 1200. Mandrel wrapping section 1300 includes a mandrel assembly 1302, a lift assembly 1304, a folding assembly 1306, and a suspension mechanism 1326 each coupled to frame 1002.

Figure 7:
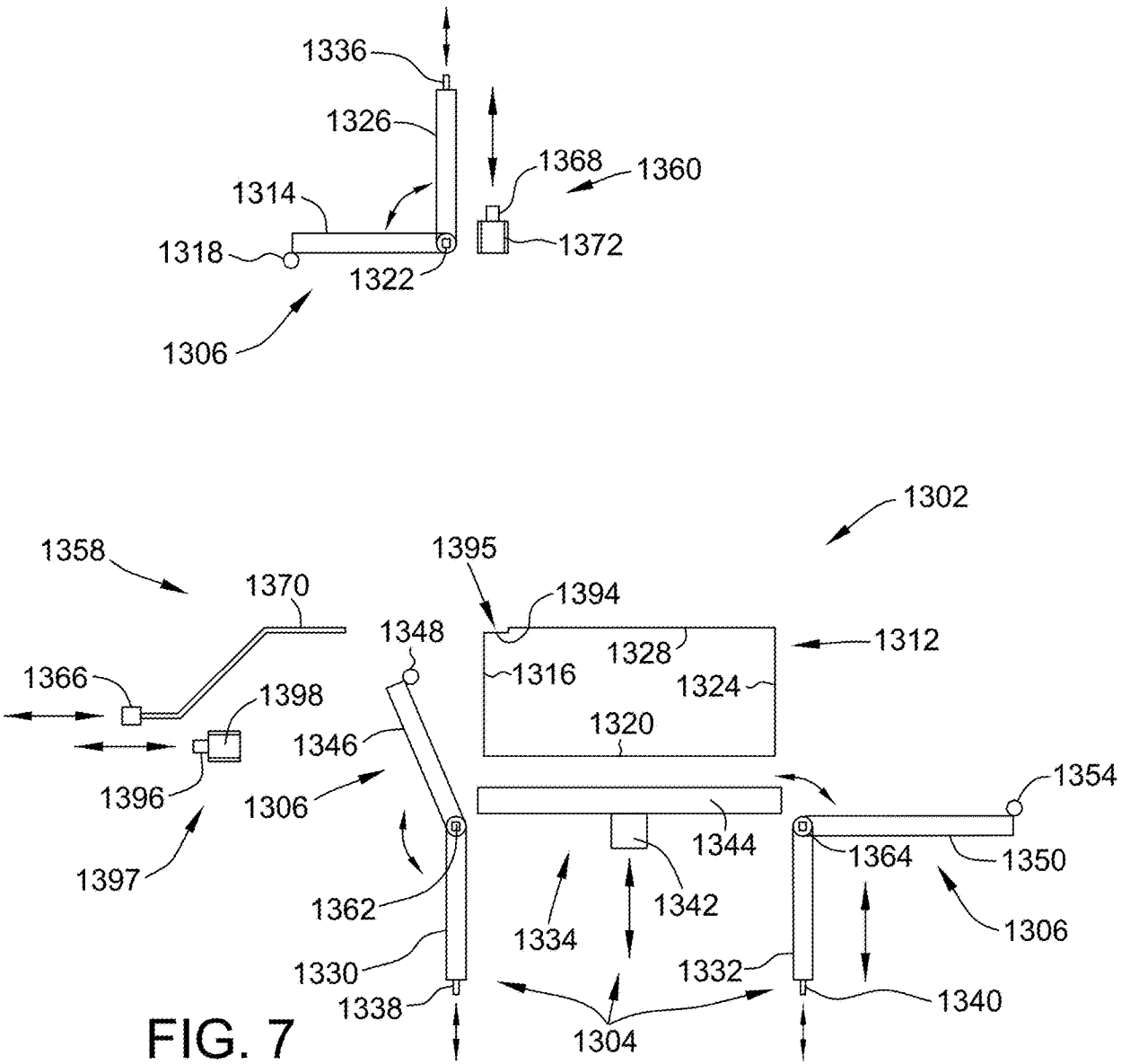
FIG. 7 is a schematic view of an example mandrel wrap section included within the example machine shown in FIGS. 5 and 6.

FIG. 7 is a schematic illustration of mandrel wrapping section 1300, viewed in the X direction from downstream to upstream. Mandrel assembly 1302 includes a mandrel 1312 mounted to frame 1002 and having a plurality of faces. In the example embodiment, mandrel 1312 includes a first side face 1316, a bottom face 1320, a second side face 1324, and a top face 1328. First side face 1316, bottom face 1320, second side face 1324, and top face 1328 are shaped to correspond to front end panel 36, second side panel 32, rear end panel 28, and first side panel 24, respectively, of blank 10. Thus, an external shape of mandrel 1312 is complementary to an internal shape of at least a portion of container 200. Any of the mandrel faces can be solid plates, frames, plates including openings defined therein, and/or any other suitable component that provides a face and/or surface configured to enable a container to be formed from a blank as described herein.

In addition, in the example embodiment, lift assembly 1304 includes a first lift mechanism 1330, a second lift mechanism 1332, and an under plate assembly 1334. In certain embodiments, one or more of first lift mechanism 1330, second lift mechanism 1332, and under plate assembly 1334 are coupled to a lifting frame (not shown), which is coupled to frame 1002. In the example embodiment, first lift mechanism 1330 includes an actuator 1338, second lift mechanism 1332 includes an actuator 1340, and under plate assembly 1334 includes an actuator 1342. Actuators 1338, 1340, and/or 1342 each are configured, in combination with first lift mechanism 1330, second lift mechanism 1332, and under plate assembly 1334, to lift blank 10 toward and/or against mandrel assembly 1302. As such, lift assembly 1304 is positioned adjacent mandrel assembly 1302. Under plate assembly 1334 includes a plate 1344 configured to lift blank 10 towards mandrel 1312. Lift mechanisms 1330 and 1332 assist folding assembly 1306 in wrapping blank 10 about mandrel 1312, as described in more detail below. In an alternative embodiment, lift mechanisms 1330 and 1332 are connected to a single actuator for lifting lift mechanisms 1330 and 1332 in unison.

Folding assembly 1306 includes a lateral presser arm 1346 (a "first presser arm") having an engaging bar 1348; a second presser arm 1314 having an engaging bar 1318; a folding arm 1350 having an engaging bar 1354; a glue panel folder assembly 1358; a glue panel presser assembly 1360; a reinforcement panel presser assembly 1397; and a plurality of actuators 1362, 1322, 1336, 1364, 1366, 1368, and 1396. These assemblies also include devices such as, but not limited to, guide rails and mechanical fingers (not shown).

In the example embodiment, lateral presser arm 1346 is coupled to first lift mechanism 1330 at actuator 1362, and is positionable generally proximate a first side of mandrel 1312 defined by mandrel first side face 1316. Folding arm 1350 is coupled to second lift mechanism 1332 at actuator 1364, and is positionable generally proximate both an opposite second side of mandrel 1312 defined by mandrel second side face 1324, and a top side of mandrel 1312 defined by mandrel top face 1328. In alternative embodiments, folding arm 1350 is positionable generally at least proximate the opposite second side of mandrel 1312. Second presser arm 1314 is coupled to suspension mechanism 1326 at actuator 1322. Suspension mechanism 1326 may be raised and lowered by actuator 1336. Thus, second presser arm 1314 is disposed generally proximate lateral presser arm 1346 and first lift mechanism 1330 and positionable generally proximate the first side of mandrel 1312. In the example embodiment, second presser arm 1314 is disposed generally above lateral presser arm 1346.

Glue panel folder assembly 1358 is positioned laterally from mandrel first side face 1316. Glue panel folder assembly 1358 includes a plate 1370 and actuator 1366. In the example embodiment, actuator 1366 is configured to move glue panel folder plate 1370 toward and away from mandrel first side face 1316 in a generally linear motion. Alternatively or additionally, actuator 1366 is configured to move glue panel folder plate 1370 toward and away from mandrel first side face 1316 in a rotational motion.

Glue panel presser assembly 1360 includes a presser bar 1372 coupled to actuator 1368 that controls movement of presser bar 1372 toward and away from mandrel top face 1328. In the example embodiment, glue panel presser assembly 1360 is positioned generally above lateral presser arm 1346 and first lift mechanism 1330. More specifically, glue panel presser assembly 1360 is positioned above an edge portion 1394 of top face 1328 that is proximate to first side face 1316. In the example embodiment, edge portion 1394 is slightly recessed relative to top face 1328 such that an indentation or pocket 1395 is formed. Pocket 1395 is sized to receive glue panel 38, as will be described in more detail below.

Reinforcement panel presser assembly 1397 is positioned proximate the first side of mandrel 1312 defined by mandrel first side face 1316. Reinforcement panel presser assembly 1397 includes a presser bar 1398 coupled to actuator 1396 that controls movement of presser bar 1398 toward and away from mandrel first side face 1316.

Figure 8:
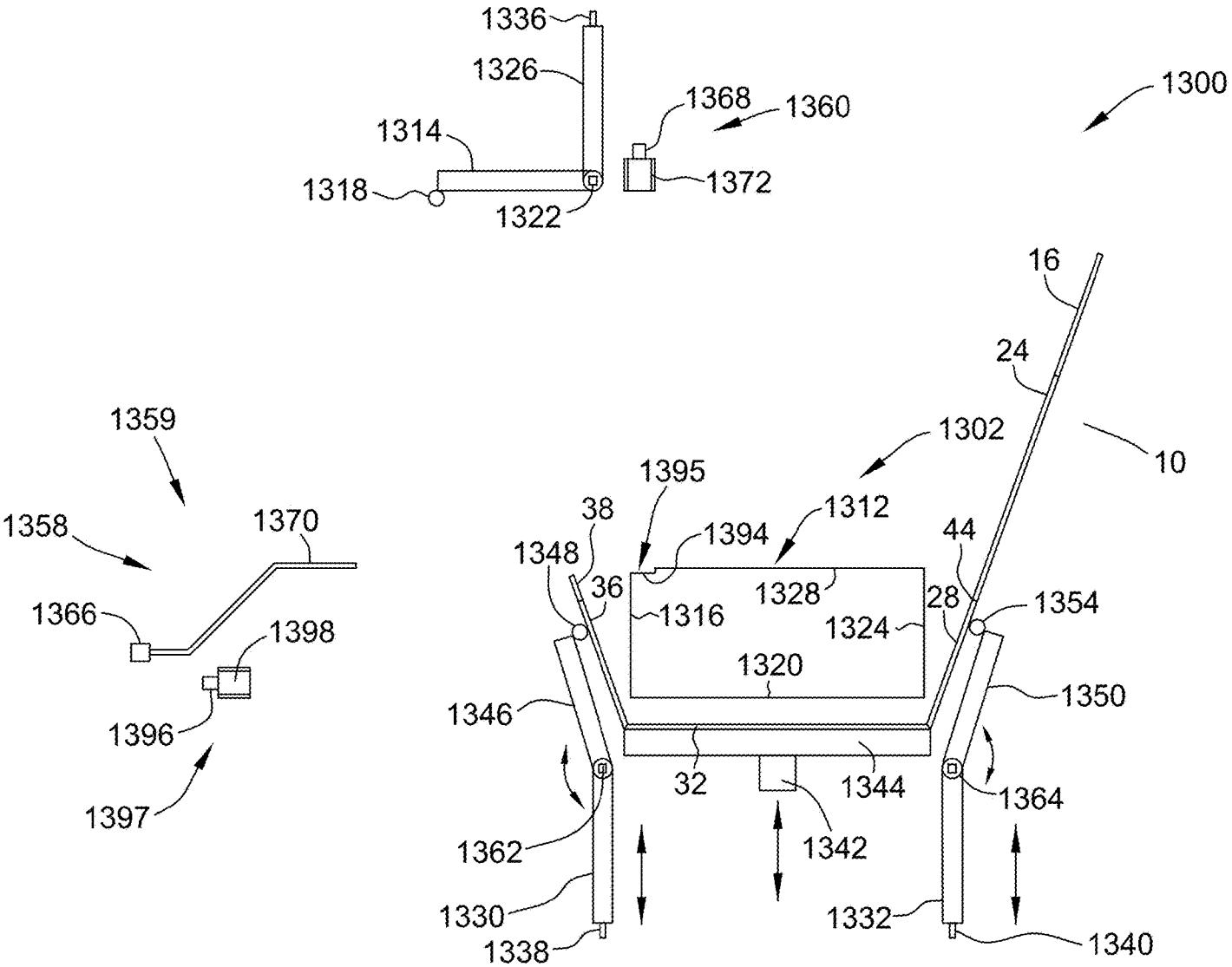
FIG. 8 is a schematic view of the example blank shown in FIG. 1 received in the example mandrel wrap section shown in FIG. 7.

FIG. 8 is a schematic illustration of mandrel wrapping section 1300, viewed upstream into the X direction, with a blank 10 received from transfer section 1200 onto lift assembly 1304. In the example embodiment, mandrel wrapping section 1300 is configured such that second side panel 32 is received adjacent to plate 1344 for lifting against bottom face 1320 of mandrel 1312. Similarly, front end panel 36 is received adjacent to engaging bar 1348 of lateral presser arm 1346, and rear end panel 28 is received adjacent to engaging bar 1354 of folding arm 1350. Lateral presser arm 1346 and/or first lift mechanism 1330 are configured to wrap a first portion of blank 10 about mandrel 1312, folding arm 1350 and/or second lift mechanism 1332 are configured to wrap a second portion of blank 10 about mandrel 1312, and second presser arm 1314 and/or suspension mechanism 1326 are configured to wrap a third portion of blank 10 about mandrel 1312, as is described in more detail below.

More specifically, lateral presser arm engaging bar 1348 is configured to contact second end panel 36 and/or glue panel 38 and fold panels 36 and/or 38 about mandrel 1312 as lateral presser arm 1346 is rotated by actuator 1362 and/or lifted by first lift mechanism 1330 and actuator 1338. Folding arm engaging bar 1354 is configured to contact first end panel 28 and/or first side panel 24 to wrap blank 10 about mandrel 1312 as folding arm 1350 is rotated by actuator 1364 and/or lifted by second lift mechanism 1332 and actuator 1340. Second presser arm engaging bar 1318 is configured to contact reinforcement panel 16 and fold reinforcement panel 16 about mandrel 1312 as second presser arm 1314 is rotated by actuator 1322 and/or lowered by suspension mechanism 1326 and actuator 1336. In the example embodiment, glue panel folder assembly 1358 is movable between a first position 1359, configured to provide sufficient clearance from mandrel first side face 1316 to avoid interference with the wrapping of front end panel 36 and/or reinforcement panel 16 about mandrel 1312, and a second position 1361 (shown in FIG. 10), configured to cause glue panel folder plate 1370 to fold glue panel 38 against mandrel 1312.

Figure 9:
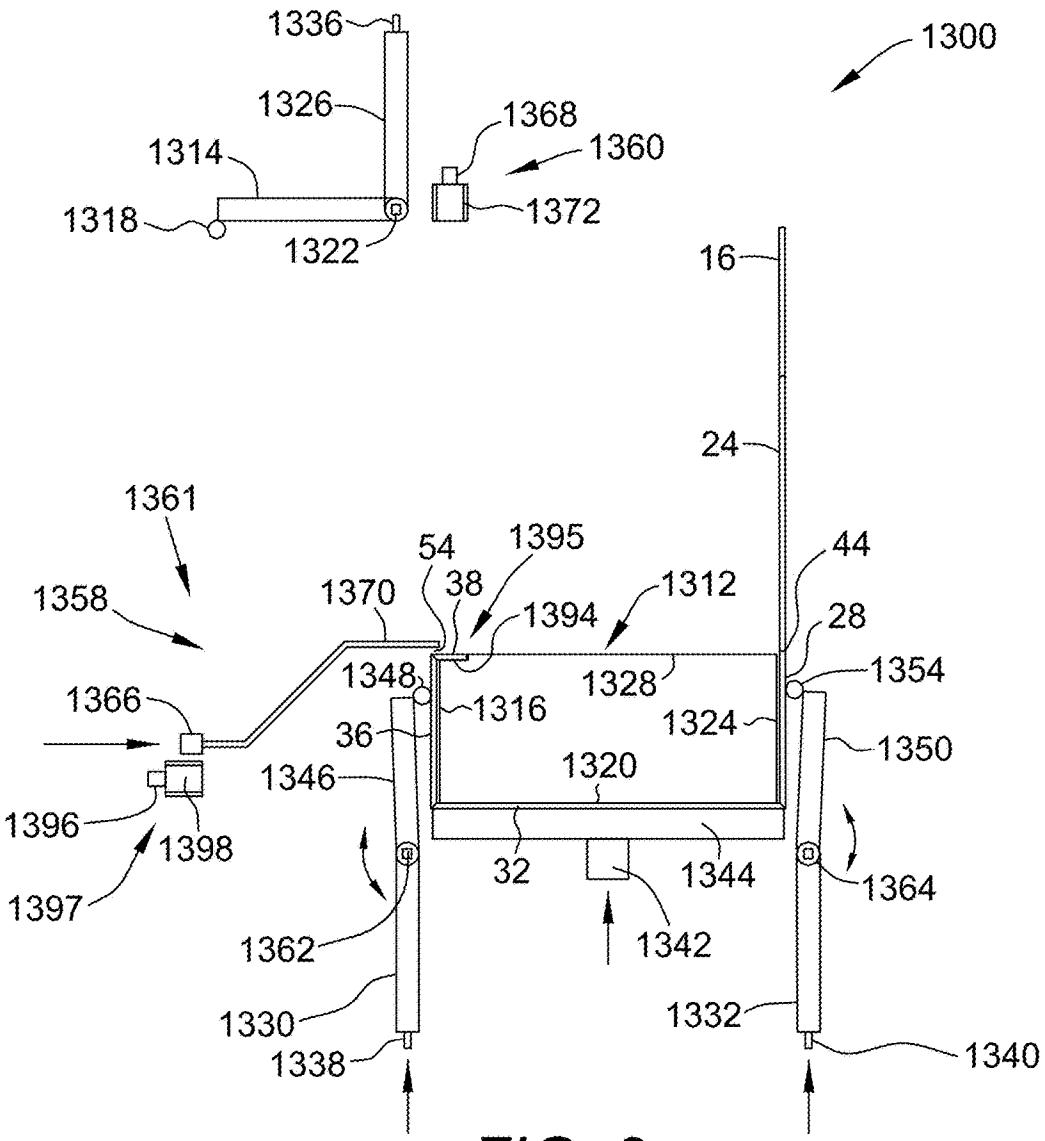
FIG. 9 is a schematic view of the example blank shown in FIG. 1 in a first configuration in the example mandrel wrap section shown in FIG. 7, with a glue panel folder assembly positioned for tucking a glue panel against the mandrel.

FIG. 9 is a schematic illustration of mandrel wrapping section 1300, viewed upstream into the X direction, with blank 10 in a first configuration about mandrel 1312. In the example embodiment, to reach the first configuration shown in FIG. 9, under plate 1344 lifts second side panel 32 to be adjacent to and/or in contact with mandrel bottom face 1320. Folding arm 1350 engages rear end panel 28, rotating rear end panel 28 about fold line 48 and into face-to-face contact with mandrel second side face 1324. More specifically, as second lift mechanism 1332 is raised using actuator 1340, folding arm 1350 is lifted by second lift mechanism 1332 and/or rotated toward mandrel 1312 using actuator 1364, causing folding arm 1350 and/or folding arm engaging bar 1354 to rotate rear end panel 28 as described. Additionally or alternatively, second lift mechanism 1332 may contact rear end panel 28 and cause it to rotate toward mandrel 1312. In an embodiment, actuator 1364 is driven to rotate folding arm 1350 using a mechanical linkage or other suitable mechanism. In an alternative embodiment, actuator 1364 is a servomechanism, and control system 1004 is configured such that, after second lift mechanism 1332 reaches a predetermined location, folding arm 1350 can be rotated toward mandrel 1312 using servomechanism actuator 1364 to control the speed, force, and location of folding arm 1350. In another alternative embodiment, folding arm 1350 is not rotated as second lift mechanism 1332 lifts folding arm 1350.

Similarly, lateral presser arm 1346 engages front end panel 36, rotating front end panel 36 about fold line 52 and into face-to-face contact with mandrel first side face 1316. More specifically, as first lift mechanism 1330 is raised using actuator 1338, lateral presser arm 1346 is lifted by first lift mechanism 1330 and/or rotated toward mandrel 1312 using actuator 1362, causing lateral presser arm 1346 and/or lateral presser arm engaging bar 1348 to rotate front end panel 36 as described. In an embodiment, actuator 1362 is driven to rotate lateral presser arm 1346 using a mechanical linkage or other suitable mechanism. In an alternative embodiment, actuator 1362 is a servomechanism, and control system 1004 is configured such that, after first lift mechanism 1330 reaches a predetermined location, lateral presser arm 1346 can be rotated toward mandrel 1312 using servomechanism actuator 1362 to control the speed, force, and location of lateral presser arm 1346. In another alternative embodiment, lateral presser arm 1346 is not rotated as first lift mechanism 1330 lifts lateral presser arm 1346. In certain embodiments, lateral presser arm engaging bar 1348 also engages glue panel 38, rotating glue panel 38 about fold line 54 at least partially towards mandrel top face 1328.

Lateral presser arm 1346 then holds a stationary position configured to retain front end panel 36 against mandrel first side face 1316, as illustrated in FIG. 9. Glue panel folder assembly 1358 moves toward mandrel 1312 to second position 1361, which causes glue panel folder plate 1370 to engage glue panel 38, rotating glue panel 38 about fold line 54 into face-to-face contact with edge portion 1394 of top face 1328. In the example embodiment, glue panel 38 is received in pocket 1395 such that exterior surface 14 of glue panel 38 is substantially flush with mandrel top face 1328.

Figure 10:
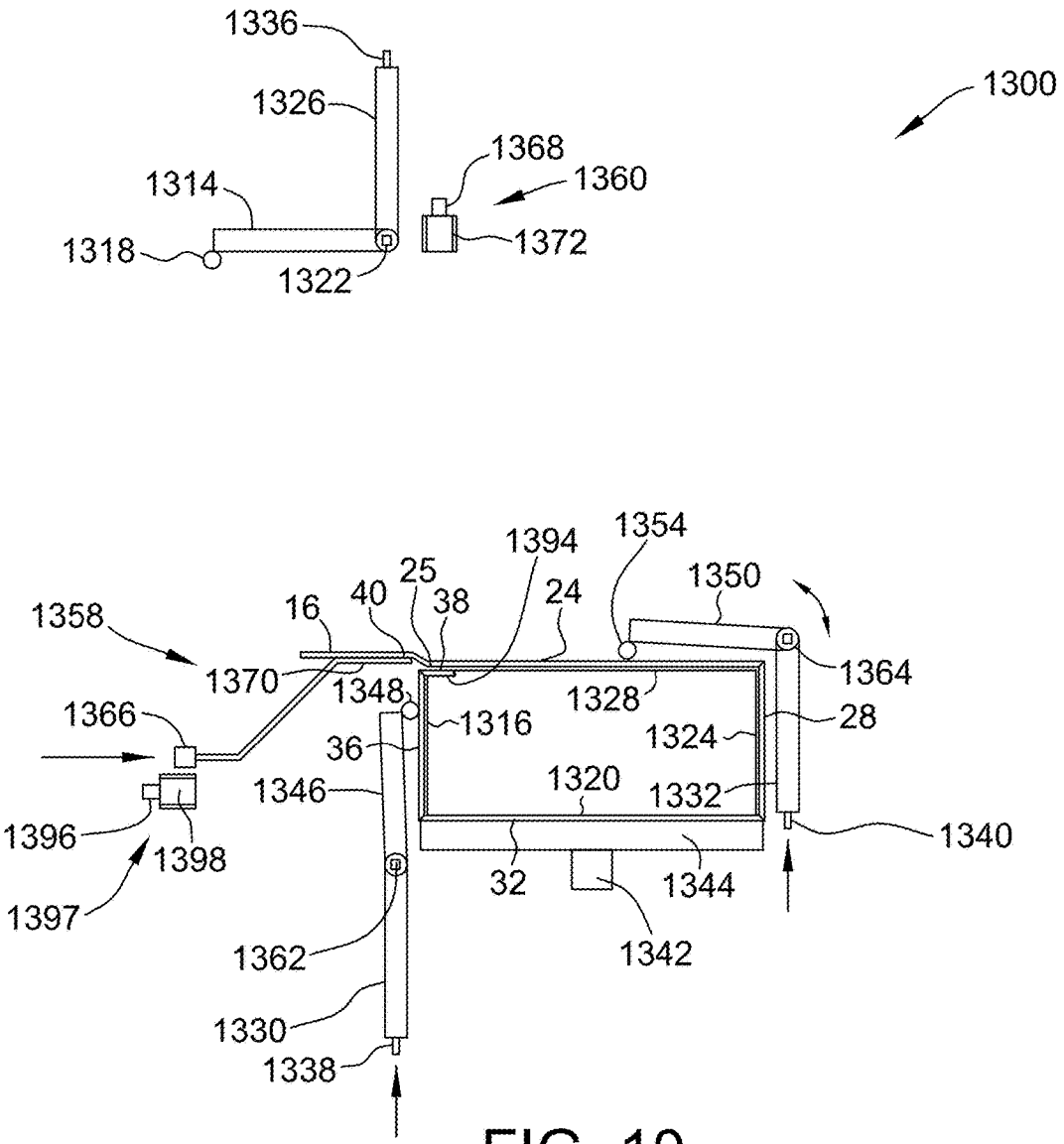
FIG. 10 a schematic view of the example blank shown in FIG. 1 in a second configuration in the example mandrel wrap section shown in FIG. 7, with a folding arm positioned for wrapping the blank against a top face of the mandrel.

FIG. 10 is a schematic illustration of mandrel wrapping section 1300, viewed upstream into the X direction, with blank 10 in a second configuration about mandrel 1312. In the example embodiment, to reach the second configuration shown in FIG. 10, folding arm 1350 engages first side panel 24, rotating first side panel 24 about fold line 44 such that a portion 25 of first side panel 24 adjacent to fold line 40 contacts exterior surface 14 of glue panel 38, and a remaining portion of first side panel 24 comes substantially into face-to-face contact with mandrel top face 1328. More specifically, as second lift mechanism 1332 is raised using actuator 1340, folding arm 1350 is lifted by second lift mechanism 1332 and/or rotated toward mandrel 1312 using actuator 1364, causing folding arm 1350 and/or folding arm engaging bar 1354 to rotate first side panel 24 as described. In an embodiment, actuator 1364 is driven to rotate folding arm 1350 using a mechanical linkage or other suitable mechanism. In an alternative embodiment, actuator 1364 is a servomechanism, and control system 1004 is configured such that, after second lift mechanism 1332 reaches a predetermined location, folding arm 1350 can be rotated toward mandrel 1312 using servomechanism actuator 1364 to control the speed, force, and location of folding arm 1350. In another alternative embodiment, folding arm 1350 is not rotated as second lift mechanism 1332 lifts folding arm 1350. In addition, at least a portion of reinforcement panel 16 contacts glue panel folder plate 1370, such that reinforcement panel 16 is maintained in a substantially parallel relationship with at least the portion of first side panel 24 in contact with mandrel top face 1328 until glue panel folder assembly 1358 is withdrawn from or moved away from mandrel 1312.

Folding arm engaging bar 1354 then holds a stationary position configured to retain first side panel 24 against mandrel top face 1328, as illustrated in FIG. 10. In the example embodiment, second lift mechanism 1332 is configured to contact first end panel 28 adjacent fold line 44 to facilitate aligning and folding panels 24 and 28 against mandrel 1312. Alternatively or in addition, a squaring bar (not shown) is disposed on folding arm 1350 to contact first end panel 28 adjacent fold line 44 to facilitate aligning and folding panels 24 and 28 against mandrel 1312.

Figure 11:
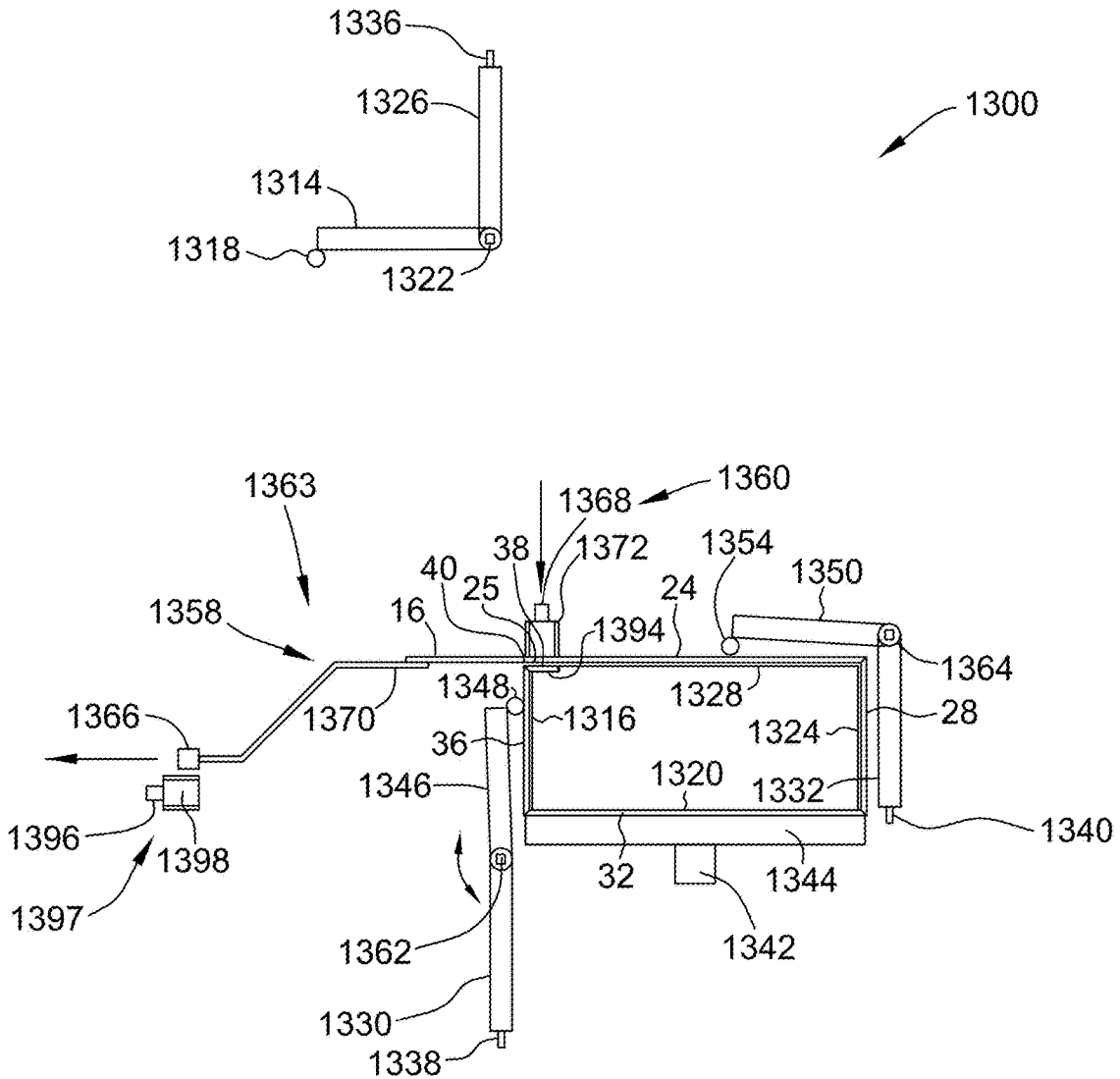
FIG. 11 a schematic view of the example blank shown in FIG. 1 in the second configuration in the example mandrel wrap section shown in FIG. 7, with the glue panel folder assembly positioned for holding a reinforcement panel away from the mandrel.

FIG. 11 is a schematic illustration of mandrel wrapping section 1300, viewed upstream into the X direction, with blank 10 in the second configuration about mandrel 1312 and glue panel presser bar 1372 in contact with portion 25 of first side panel 24. In the example embodiment, glue panel presser bar 1372 is configured to press portion 25 and glue panel 38 together against edge portion 1394 of mandrel top face 1328 to form a manufacturing joint. Actuator 1368 holds glue panel presser bar 1372 against portion 25 and glue panel 38 for a predetermined time period and/or duration to ensure that adhesive previously applied to glue area 118 on glue panel 38 bonds panels 24 and 38 together. The predetermined time period and/or duration can be selected based on the size and/or type of container, a material of the container, a type of adhesive and/or any other suitable variables.

Actuator 1366 moves glue panel folder assembly 1358 away from mandrel first side face 1316 immediately prior to, and/or during, glue panel presser bar 1372 pressing down on portion 25 of first side panel 24. Thus, glue panel folder plate 1370 is removed from engagement with glue panel 38 to prevent glue panel folder plate 1370 from interfering with formation of the manufacturing joint between portion 25 and glue panel 38. In the example embodiment, as illustrated in FIG. 11, glue panel folder assembly 1358 is moved to a third position 1363 such that glue panel folder plate 1370 supports reinforcement panel 16 in a horizontal extended position while glue panel presser bar 1372 presses portion 25 and glue panel 38 together against edge portion 1394. In alternative embodiments, glue panel folder assembly 1358 is moved to a position, such as first position 1359, such that glue panel folder plate 1370 does not contact reinforcement panel 16 while glue panel presser bar 1372 presses portion 25 and glue panel 38 together against edge portion 1394.

Figure 12:
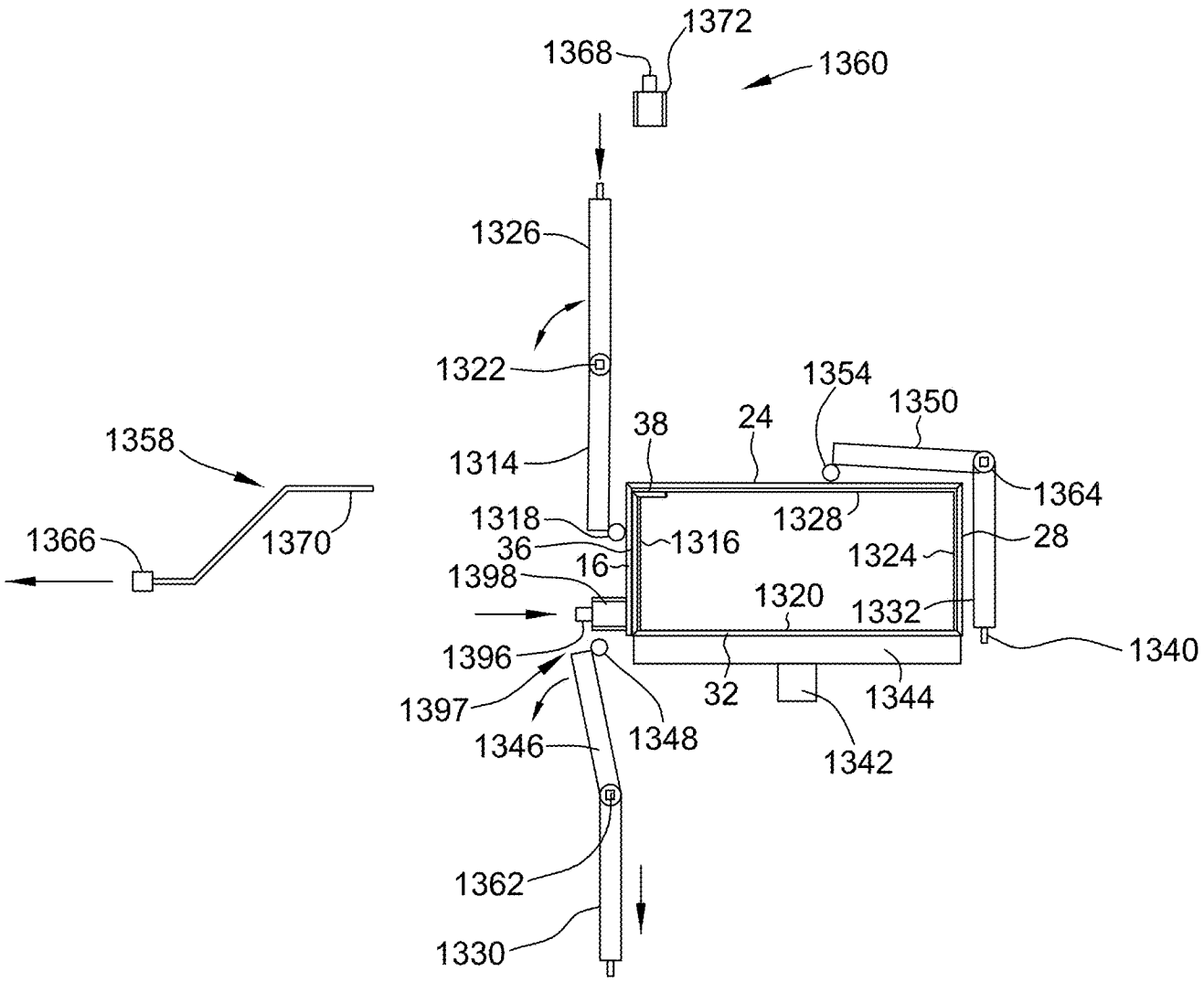
FIG. 12 a schematic view of the example blank shown in FIG. 1 in a third configuration in the example mandrel wrap section shown in FIG. 7, with a second presser arm positioned for wrapping the reinforcement panel against the mandrel.

FIG. 12 is a schematic illustration of mandrel wrapping section 1300, viewed upstream into the X direction, with blank 10 in a third configuration about mandrel 1312 and reinforcement panel presser bar 1398 in contact with reinforcement panel 16. In the example embodiment, to reach the third configuration shown in FIG. 12, lateral presser arm 1346 is rotated by actuator 1362 and/or lowered by first lift mechanism 1330 and actuator 1338 away from mandrel 1312 to avoid interference with a rotation of reinforcement panel 16. Similarly, glue panel folder assembly is returned to first position 1359 to avoid interference by glue panel folder plate 1370 with rotation of reinforcement panel 16.

Second presser arm 1314 engages reinforcement panel 16, rotating reinforcement panel 16 about fold line 40 such that reinforcement panel 16 comes substantially into face-to-face contact with front end panel 36. More specifically, as suspension mechanism 1326 is lowered using actuator 1336, second presser arm 1314 is lowered by suspension mechanism 1326 and/or rotated toward mandrel 1312 using actuator 1322, causing second presser arm 1314 and/or engaging bar 1318 to rotate reinforcement panel 16 as described. In an embodiment, actuator 1322 is driven to rotate second presser arm 1314 using a mechanical linkage or other suitable mechanism. In an alternative embodiment, actuator 1322 is a servomechanism, and control system 1004 is configured such that, after suspension mechanism 1326 reaches a predetermined location, second presser arm 1314 can be rotated toward mandrel 1312 using servomechanism actuator 1322 to control the speed, force, and location of second presser arm 1314. In another alternative embodiment, second presser arm 1314 is not rotated as suspension mechanism 1326 lowers second presser arm 1314.

When blank 10 is in the third configuration, reinforcement panel presser bar 1398 presses reinforcement panel 16 and front end panel 36 together against mandrel first side face 1316 to couple together reinforcement panel 16 and front end panel 36. In particular, in the example embodiment, reinforcement panel presser bar 1398 is configured to contact at least a portion of reinforcement panel 16 that is adjacent to glue area 120 (e.g., above cut line 82) on front end panel 36 when reinforcement panel 16 is in face-to-face contact with front end panel 36. Actuator 1396 holds reinforcement panel presser bar 1398 against panels 16 and 36 for a predetermined time period and/or duration to ensure that adhesive previously applied to glue area 120 on front end panel 36 bonds panels 16 and 36 together. The predetermined time period and/or duration can be selected based on the size and/or type of container, the material of the container, the type of adhesive and/or any other suitable variables.

Accordingly, lateral presser arm 1346, second presser arm 1314, folding arm 1350, glue panel folder assembly 1358, glue panel presser assembly 1360, and reinforcement panel presser assembly 1397 cooperate to fold blank 10 along fold lines 40, 44, 48, 52, and 54 to form container 200.

In the example embodiment, mandrel wrapping section 1300 includes a bottom folder assembly (not shown) configured to fold bottom end panels 102 and 96 about fold lines 106 and 100, respectively, to fold bottom side panels 62 and 68 about fold lines 66 and 72, respectively, and to press bottom panels 62, 68, 96, and/or 102 together to form bottom wall 222 of container 200. In the example embodiment, container 200 is ejected from mandrel wrapping section 1300 in filling configuration 204. In alternative embodiments, blank 10 is ejected from mandrel wrapping section 1300 as a partially assembled container 200 with portion 25 of first side panel 24 coupled to glue panel 38 in the manufacturing joint, and with reinforcement panel 16 coupled to front end panel 36. In this partially assembled configuration, with bottom wall 222 and top wall 224 (shown in FIG. 3) not yet formed, container 200 can be "knocked down flat" (KDF) and shipped flat to a customer facility for later erection into filling configuration 204 (shown in FIG. 2) and filling with product. In certain embodiments, shipping container 200 to the customer facility in KDF configuration facilitates a decreased overall logistical cost. Mandrel wrapping section 1300 includes any suitable ejection mechanism for ejecting blank 10 from mandrel 1312 in one or more desired configurations.

Returning to FIGS. 5 and 6, in the example embodiment, machine 1000 also includes outfeed section 1400 and product load section 1500. Outfeed section 1400 is configured to move containers 200 ejected from mandrel wrapping section 1300 toward product load section 1500, such as by a conveyor assembly (not shown), for example. In product load section 1500, product is loaded into container 200, and container 200 is closed and sealed in shipping configuration 208 for shipping and/or storing the product. More specifically, after container 200 is provided with product, top panels 60, 70, 84, and 104 are closed to form top wall 224. In alternative embodiments, outfeed section 1400 is configured to move containers 200 to a shipping station (not shown), where containers 200 are converted to KDF configuration and bundled for shipping.

Figure 13:
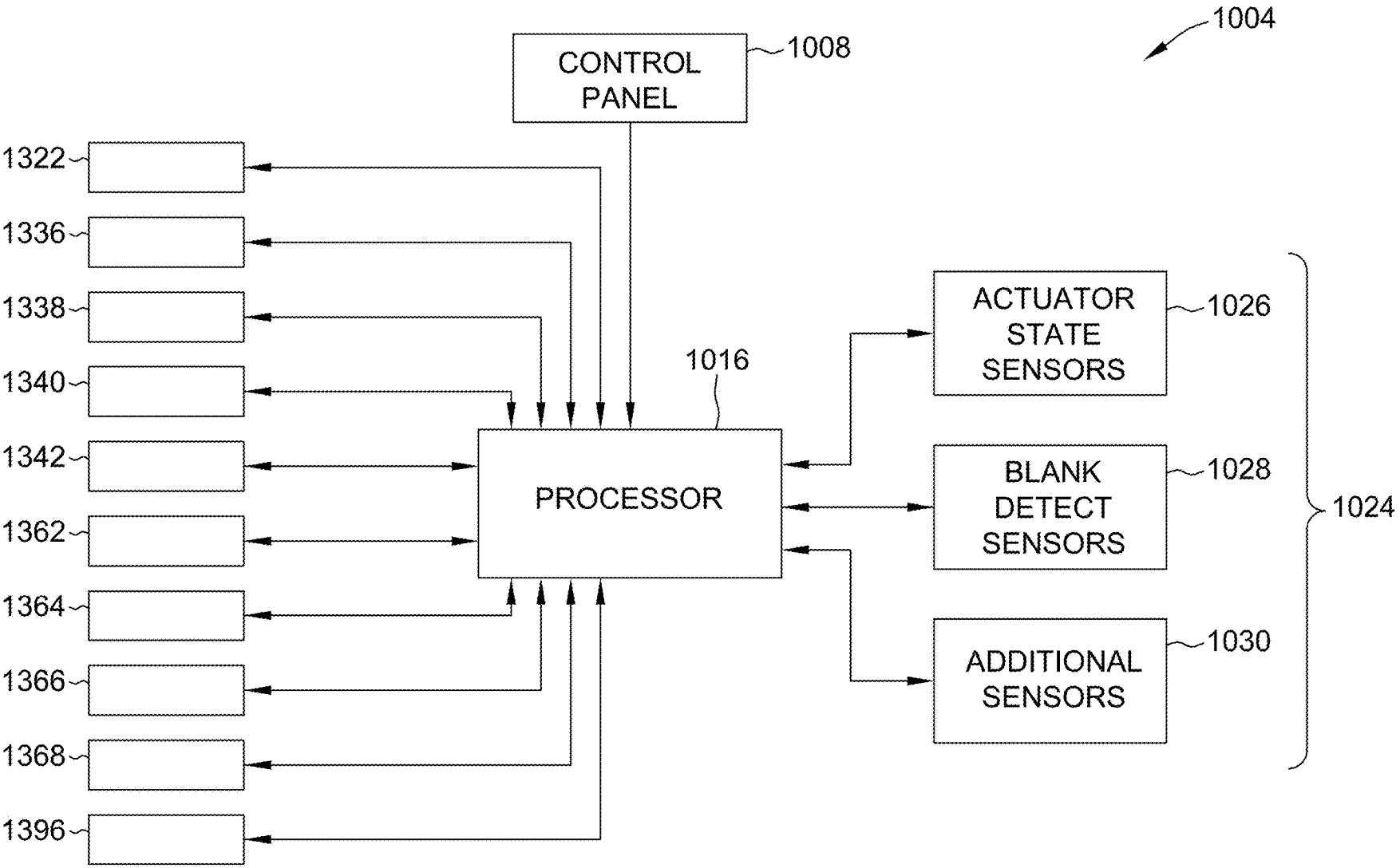
FIG. 13 is a schematic view of an example control system that may be used with the example machine shown in FIGS. 5 and 6.

FIG. 13 is a schematic illustration of control system 1004. In the example embodiment, control system 1004 includes at least one control panel 1008 and at least one processor 1016. In certain embodiments, reprogrammed recipes or protocols embodied on a non-transitory computer-readable medium are programmed in and/or uploaded into processor 1016 and such recipes include, but are not limited to, predetermined speed and timing profiles, wherein each profile is associated with blanks of a predetermined size and shape.

In the example embodiment, one or more of actuators 1322, 1336, 1338, 1340, 1342, 1362, 1364, 1366, 1368, and 1396 are integrated with machine control system 1004, such that control system 1004 is configured to transmit signals to each actuator to control its operation. Moreover, a plurality of suitable sensors 1024 are disposed on machine 1000 and provide feedback to control system 1004 to enable machine 1000 to function as described herein. For example, plurality of sensors 1024 includes a first set 1026 of sensors to monitor a state of one or more of actuators 1322, 1336, 1338, 1340, 1342, 1362, 1364, 1366, 1368, and 1396, wherein the state includes at least a position of the respective actuator. In addition, in certain embodiments, machine 1000 is configured to assemble containers of any size and any shape without limitation. Therefore, to accommodate the assembly of such a large variety of containers, plurality of sensors 1024 includes a second set 1028 of suitable sensors to enable machine control system 1004 to automatically detect dimensional features of blanks 10 of varying shapes and sizes, including, but not limited to, length, width, and/or depth. Plurality of sensors 1024 also includes a variety of additional sensors 1030 suitable for enabling control system 1004 and machine 1000 to operate as described herein.

Control system 1004 is configured to facilitate selecting a speed and timing of the movement of the devices and/or components associated with each of actuators 1322, 1336, 1338, 1340, 1342, 1362, 1364, 1366, 1368, and 1396. The devices and/or components may be controlled either independently or as part of one or more linked mechanisms. For example, in embodiments where one or more of actuators 1322, 1336, 1338, 1340, 1342, 1362, 1364, 1366, 1368, and 1396 is a servomechanism, the speed and timing of each such actuator can be controlled independently as commanded by control system 1004.

In certain embodiments, control panel 1008 allows an operator to select a recipe that is appropriate for a particular blank. The operator typically does not have sufficient access rights/capabilities to alter the recipes, although select users can be given privileges to create and/or edit recipes. Each recipe is a set of computer instructions that instruct machine 1000 as to forming the container. For example, machine 1000 is instructed as to speed and timing of picking a blank from magazine feed section 1100, speed and timing of transferring the blank under mandrel 1312, speed and timing of lifting the blank into contact with mandrel 1312, speed and timing of moving lateral presser arm 1346, speed and timing of moving folding arm 1350, speed and timing of second presser arm 1314, and speed and timing of transferring the formed container to outfeed section 1400. In embodiments where one or more actuators is a servomechanism, control system 1004 is able to control the movement of each such actuator independently relative to any other component of machine 1000. This enables an operator to maximize the number of containers that can be formed by machine 1000, easily change the size of containers being formed on machine 1000, and automatically change the type of containers being formed on machine 1000 without manually adjusting machine 1000. As used herein, a type of container refers to containers having the same number of sides and the same overall length of the blank, but may have different depth dimensions and/or top panel configurations. Further, as used herein, a size of container refers to containers that may have different numbers of sides, different blank length dimensions, different blank depth dimensions, and/or different top panel configurations.

In certain embodiments, control system 1004 is also configured to facilitate dynamic control of the container-forming process. More specifically, if the blanks to be formed into containers are not uniform with respect to, for example, the associated depth dimension (i.e., the depth or height of the box), the sensors will generate and transmit a signal to processor 1016 that will alter the movement of one or more of actuators 1322, 1336, 1338, 1340, 1342, 1362, 1364, 1366, 1368, and 1396 to accommodate the differing depth dimensions dynamically.

The example embodiments described herein provide a container-forming machine that accommodates blanks that include a reinforcement panel in series with the side walls and end walls, such as blanks used to form shelf-ready shipper display containers. The example embodiments advantageously facilitate eliminating interference by the reinforcement panel with the operation of the glue panel folder plate and glue panel presser when the blank is wrapped about the mandrel. Thus, the example embodiments facilitate a high-speed machine process that produces shelf-ready shipper display containers, as well as other containers with reinforcement panels. In addition, the machine and process may produce containers in a configuration that is ready for shipping in a knocked-down flat configuration.

Example embodiments of methods and a machine for forming a container from a blank are described above in detail. The methods and machine are not limited to the specific embodiments described herein, but rather, components of systems and/or steps of the methods may be utilized independently and separately from other components and/or steps described herein. For example, the machine may also be used in combination with other blanks and containers, and is not limited to practice with only the blank and container described herein.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A machine for forming a container from a blank, wherein the blank includes a reinforcement panel, a first side panel, a first end panel, a second side panel, a second end panel, and a glue panel connected in series along a plurality of parallel fold lines, said machine comprising:

a mandrel coupled to a frame, said mandrel having a first side, an opposite second side, and an external shape complementary to an internal shape of at least a portion of the container;

a first presser arm associated with the frame, said first presser arm positionable generally proximate said first side of said mandrel, said first presser arm configured to wrap a first portion of the blank including at least the second end panel about said mandrel;

a folding arm associated with the frame, said folding arm positionable at least generally proximate said second side of said mandrel, said folding arm configured to wrap a second portion of the blank including at least the first end panel and the first side panel about said mandrel;

a second presser arm associated with the frame, said second presser arm disposed generally proximate said first presser arm, said second presser arm configured to wrap a third portion of the blank including at least the reinforcement panel about said mandrel and into face-to-face contact with the second end panel;

a reinforcement panel presser assembly associated with the frame, said reinforcement panel presser assembly configured to press the reinforcement panel and the second end panel together against said mandrel to couple the reinforcement panel and the second end panel together;

a glue panel folder assembly associated with the frame, said glue panel folder assembly configured to rotate the glue panel into contact with said mandrel; and a glue panel presser assembly associated with the frame, said glue panel presser assembly configured to press the glue panel and a portion of the first side panel together against said mandrel to form a manufacturing joint of the container.

2. The machine in accordance with claim 1, further comprising:

a first lift mechanism coupled to said first presser arm and associated with the frame;

a second lift mechanism coupled to said folding arm and associated with the frame; and a suspension mechanism coupled to said second presser arm and associated with the frame.

3. The machine in accordance with claim 1, wherein said first presser arm is operatively coupled to a first servomechanism, said folding arm is operatively coupled to a second servomechanism, and said second presser arm is operatively coupled to a third servomechanism, said machine further comprising a control system in communication with said first servomechanism, said second servomechanism, and said third servomechanism, said control system is configured to transmit a signal to each of said first, second, and third servomechanisms to independently control movement of said first presser arm, said folding arm, and said second presser arm to wrap at least the first, second, and third portions of the blank about said mandrel to form the container.

4. The machine in accordance with claim 3, further comprising:

a first lift mechanism coupled to said first presser arm and associated with the frame;

a second lift mechanism coupled to said folding arm and associated with the frame; and a suspension mechanism coupled to said second presser arm and associated with the frame, wherein said first lift mechanism is operatively coupled to a fourth servomechanism, said second lift mechanism is operatively coupled to a fifth servomechanism, and said suspension mechanism is operatively coupled to a sixth servomechanism, wherein said control system is in communication with said fourth servomechanism, said fifth servomechanism, and said sixth servomechanism, said control system is further configured to transmit a signal to each of said fourth, fifth, and sixth servomechanisms to independently control movement of said first lift mechanism, said second lift mechanism, and said suspension mechanism to wrap at least the first, second, and third portions of the blank about said mandrel to form the container.

5. The machine in accordance with claim 1, wherein said glue panel folder assembly is movable between a first position configured to provide sufficient clearance from said mandrel to avoid interference with a wrapping of at least one of the second end panel and the reinforcement panel about said mandrel, and a second position configured to position the glue panel against said mandrel.

6. The machine in accordance with claim 1, wherein said glue panel presser assembly is operatively coupled to a seventh servomechanism, said machine further comprising a control system in communication with said seventh servomechanism, said control system is configured to transmit a signal to said seventh servomechanism to hold the glue panel and the portion of the first side panel together against said mandrel for a predetermined time period such that the glue panel and the first side panel are bonded together.

7. The machine in accordance with claim 1, wherein said reinforcement panel presser assembly is operatively coupled to an eighth servomechanism, said machine further comprising a control system in communication with said eighth servomechanism, said control system is configured to transmit a signal to said eighth servomechanism to hold the reinforcement panel and the second end panel together against said mandrel for a predetermined time period such that the reinforcement panel and the second end panel are bonded together.

8. The machine in accordance with claim 1, wherein the blank is configured to form a shelf-ready shipper display container with a removable shipping cover, the removable shipping cover includes a portion of the second end panel above a cut line in the second end panel, a glue area is defined on the portion of the second end panel above the cut line, said reinforcement panel presser assembly is configured to press the reinforcement panel and the portion of the second end panel above the cut line together against said mandrel to couple the reinforcement panel and the second end panel together.

9. The machine in accordance with claim 1, wherein said second presser arm is disposed generally above said first presser arm.

10. The machine in accordance with claim 1, wherein said second presser arm is further configured to wrap the third portion of the blank including the reinforcement panel about said mandrel to directly couple the reinforcement panel and the second end panel in the face-to-face relationship.

11. A method for forming a container from a blank using a machine, wherein the blank includes a reinforcement panel, a first side panel, a first end panel, a second side panel, a second end panel, and a glue panel connected in series along a plurality of parallel fold lines, and where the machine includes a mandrel, a first presser arm positionable generally proximate a first side of the mandrel, a folding arm positionable at least generally proximate a second side of the mandrel opposite the first side, a second presser arm disposed generally proximate the first presser arm, and a reinforcement panel presser assembly, said method comprising:

positioning the blank under the mandrel;

wrapping a first portion of the blank including at least the second end panel about the mandrel using the first presser arm;

wrapping a second portion of the blank including at least the first end panel and the first side panel about the mandrel using the folding arm;

wrapping a third portion of the blank including at least the reinforcement panel about the mandrel using the second presser arm;

pressing the reinforcement panel and the second end panel together against the mandrel to couple the reinforcement panel and the second end panel together using the reinforcement presser assembly;

rotating the glue panel into contact with the mandrel using a glue panel folder assembly of the machine;

pressing the glue panel and a portion of the first side panel together against the mandrel to form a manufacturing joint of the container using a glue panel presser assembly of the machine; and ejecting the container from the mandrel after the first portion, the second portion, and the third portion of the blank are wrapped about the mandrel.

12. The method in accordance with claim 11, further comprising:

positioning the glue panel folder assembly in a first position during said wrapping at least the second end panel about the mandrel;

positioning the glue panel folder assembly in a second position during said pressing the glue panel and a portion of the first side panel together against the mandrel; and positioning the glue panel folder assembly in the first position during said wrapping at least the reinforcement panel about the mandrel.

13. The method in accordance with claim 11, wherein said pressing the glue panel and a portion of the first side panel together against the mandrel further comprises holding the glue panel and the portion of the first side panel together against the mandrel for a predetermined time period such that the glue panel and the first side panel are bonded together.

14. The method in accordance with claim 11, wherein said pressing the reinforcement panel and the second end panel together against the mandrel further comprises holding the reinforcement panel and the second end panel together against the mandrel for a predetermined time period such that the reinforcement panel and the second end panel are bonded together.

15. The method in accordance with claim 11, wherein the container comprises a shelf-ready shipper display container with a removable shipping cover, the removable shipping cover includes a portion of the second end panel above a cut line in the second end panel, a glue area is defined on the portion of the second end panel above the cut line, said pressing the reinforcement panel and the second end panel together comprises pressing the reinforcement panel and the portion of the second end panel above the cut line together against said mandrel to couple the reinforcement panel and the second end panel together.

16. A container formed from a blank using a machine that includes a mandrel, a first presser arm positionable generally proximate a first side of the mandrel, a folding arm positionable at least generally proximate a second side of the mandrel opposite the first side, and a second presser arm disposed generally proximate the first presser arm, wherein the blank includes a reinforcement panel, a first side panel, a first end panel, a second side panel, a second end panel, and a glue panel connected in series along a plurality of parallel fold lines, the container formed by the process of:

positioning the second side panel under the mandrel;

wrapping at least the second end panel about the mandrel using the first presser arm;

wrapping at least the first end panel and the first side panel about the mandrel using the folding arm;

wrapping at least the reinforcement panel about the mandrel using the second presser arm;

pressing the reinforcement panel and the second end panel together against the mandrel to couple the reinforcement panel and the second end panel together using a reinforcement presser assembly of the machine;

rotating the glue panel into contact with the mandrel using a glue panel folder assembly of the machine;

pressing the glue panel and a portion of the first side panel together against the mandrel to form a manufacturing joint of the container using a glue panel presser assembly of the machine; and ejecting the container from the mandrel after the second end panel, the first end panel, and the reinforcement panel are wrapped about the mandrel.

17. The container in accordance with claim 16, wherein the container comprises a shelf-ready shipper display container with a removable shipping cover, the removable shipping cover includes a portion of the second end panel above a cut line in the second end panel, a glue area is defined on the portion of the second end panel above the cut line, said pressing the reinforcement panel and the second end panel together comprises pressing the reinforcement panel and the portion of the second end panel above the cut line together against said mandrel to couple the reinforcement panel and the second end panel together.

* * * * *